US009193496B2

(12) United States Patent
Melrose

(10) Patent No.: US 9,193,496 B2
(45) Date of Patent: Nov. 24, 2015

(54) METHOD OF PROCESSING A CONTAINER AND BASE CUP STRUCTURE FOR REMOVAL OF VACUUM PRESSURE

(75) Inventor: David Murray Melrose, Auckland (NZ)

(73) Assignee: CO2PAC LIMITED (NZ)

( * ) Notice: Subject to any disclaimer, the term of this patent is extended or adjusted under 35 U.S.C. 154(b) by 462 days.

(21) Appl. No.: 13/244,585

(22) Filed: Sep. 25, 2011

(65) Prior Publication Data

US 2012/0180437 A1 Jul. 19, 2012

Related U.S. Application Data

(63) Continuation of application No. 11/722,081, filed as application No. PCT/NZ2005/000332 on Dec. 16, 2005, now Pat. No. 8,028,498.

(30) Foreign Application Priority Data

Dec. 20, 2004 (NZ) ..... 537375

(51) Int. Cl.

| | |
|---|---|
| ***B65B 61/24*** | (2006.01) |
| ***B65D 1/02*** | (2006.01) |
| *B65B 3/04* | (2006.01) |
| *B65B 7/28* | (2006.01) |
| *B67C 3/22* | (2006.01) |

(52) U.S. Cl.
CPC ..... *B65D 1/0276* (2013.01); *B67C 2003/226* (2013.01)

(58) Field of Classification Search
USPC ..... 53/281, 282, 289, 328, 480, 484, 486, 53/526, 527; 493/84; 206/520; 215/372, 215/376; 220/604, 606, 608, 609
See application file for complete search history.

(56) References Cited

U.S. PATENT DOCUMENTS

| | | | | |
|---|---|---|---|---|
| 2,124,959 | A * | 7/1938 | Vogel | 53/471 |
| 3,103,089 | A * | 9/1963 | Allen | 53/471 |
| 3,426,939 | A * | 2/1969 | Young | 220/609 |
| 4,035,455 | A * | 7/1977 | Rosenkranz et al. | 264/40.3 |
| 4,241,839 | A | 12/1980 | Alberghini | |
| 4,293,359 | A | 10/1981 | Jakobsen | |

(Continued)

FOREIGN PATENT DOCUMENTS

| | | |
|---|---|---|
| EP | 0229420 | 7/1987 |
| NZ | 521694 | 5/2005 |

(Continued)

OTHER PUBLICATIONS

WIPO PCT Search Report Mar. 10, 2006, PCT/NZ2005/000332, Australia Patent Office.

*Primary Examiner* — Gloria R Weeks
(74) *Attorney, Agent, or Firm* — Henricks, Slavin & Holmes LLC

(57) ABSTRACT

A Method of Processing a Container and Base Cup Structure For Removal of Vacuum Pressure A plastic container (10) has a wall extending to a lower portion including a pressure panel (20). The panel (20) is transversely oriented and can move from a downwardly inclined position providing a geometrically unstable configuration to an upwardly inclined position providing a geometrically stable configuration to control pressure change in the container. This movement may be provided by suitable actuating means such as rod (22). In the unstable configuration a base cup 50 or any other suitable holder can support the container and enable it to be conveyed in a container handling or processing system.

25 Claims, 29 Drawing Sheets

(56) References Cited

U.S. PATENT DOCUMENTS

| | | | | |
|---|---|---|---|---|
| 4,326,638 | A | 4/1982 | Nickel et al. | |
| 4,338,765 | A * | 7/1982 | Ohmori et al. | 53/452 |
| 4,438,856 | A | 3/1984 | Chang | |
| 4,441,955 | A | 4/1984 | Richardson et al. | |
| 4,658,974 | A | 4/1987 | Fujita et al. | |
| 4,667,454 | A * | 5/1987 | McHenry et al. | 53/425 |
| 4,836,398 | A * | 6/1989 | Leftault et al. | 220/609 |
| 4,919,284 | A | 4/1990 | Tiedemann et al. | |
| 5,090,180 | A | 2/1992 | Sorensen | |
| 5,428,943 | A * | 7/1995 | Balcombe | 53/432 |
| 5,829,614 | A * | 11/1998 | Collette et al. | 215/375 |
| 5,858,300 | A * | 1/1999 | Shimizu et al. | 264/521 |
| 6,277,321 | B1 * | 8/2001 | Vailliencourt et al. | 264/529 |
| 6,595,380 | B2 | 7/2003 | Silvers | |
| 6,942,116 | B2 * | 9/2005 | Lisch et al. | 215/373 |
| 7,150,372 | B2 * | 12/2006 | Lisch et al. | 215/373 |
| 7,799,264 | B2 * | 9/2010 | Trude | 264/524 |
| 8,028,498 | B2 | 10/2011 | Melrose | |
| 8,127,955 | B2 * | 3/2012 | Denner et al. | 215/373 |
| 8,152,010 | B2 * | 4/2012 | Melrose | 215/373 |
| 8,381,940 | B2 * | 2/2013 | Melrose et al. | 220/609 |
| 8,584,879 | B2 * | 11/2013 | Melrose et al. | 215/373 |
| 2004/0149677 | A1 * | 8/2004 | Slat et al. | 215/380 |
| 2004/0232103 | A1 * | 11/2004 | Lisch et al. | 215/374 |
| 2008/0047964 | A1 * | 2/2008 | Denner et al. | 220/624 |
| 2012/0011807 | A1 * | 1/2012 | Preckel et al. | 53/167 |

FOREIGN PATENT DOCUMENTS

| | | |
|---|---|---|
| WO | WO0218213 | 3/2002 |
| WO | WO2004028910 | 4/2004 |

* cited by examiner

METHOD OF PROCESSING A CONTAINER AND BASE CUP STRUCTURE FOR REMOVAL OF VACUUM PRESSURE

CROSS REFERENCE TO RELATED APPLICATIONS

This application is a Continuation of Ser. No. 11/722,081, filed Feb. 16, 2008, now U.S. Pat. No. 8,828,498, which is a National Stage Application of PCT/NZ05/00332, filed Dec. 16, 2005, claiming priority to NZ537375 filed Dec. 20, 2004.

TECHNICAL FIELD OF THE INVENTION

This invention relates generally to a container structure that allows for the removal of vacuum pressure. This is achieved by inverting a transversely oriented vacuum pressure panel located in the lower end-wall, or base region of the container. To maintain stability of the container when the base is in an outwardly protruding position, a modified base cup is applied to the container.

BACKGROUND

The discussion of the prior art throughout the specification should in no way be considered as an admission that such prior art is widely known or forms part of common general knowledge in the field.

The present invention is a development of our earlier invention described in WO 2004/028910 (our PCT specification), the equivalent New Zealand patent specification No. 521694, both of which are herein incorporated in their entirety where appropriate by way of reference. However, for the sake of completeness substantial portions of our PCT specification will be included in this present specification.

So called 'hot fill' containers are well known in prior art, whereby manufacturers supply PET containers for various liquids which are filled into the containers and the liquid product is at an elevated temperature, typically at or around 85 degrees C. (185 degrees F.).

The container is manufactured to withstand the thermal shock of holding a heated liquid, resulting in a 'heat-set' plastic container. This thermal shock is a result of either introducing the liquid hot at filling, or heating the liquid after it is introduced into the container.

Once the liquid cools down in a capped container, however, the volume of the liquid in the container reduces, creating a vacuum within the container. This liquid shrinkage results in vacuum pressures that pull inwardly on the side and end walls of the container. This in turn leads to deformation in the walls of plastic bottles if they are not constructed rigidly enough to resist such force.

Typically, vacuum pressures have been accommodated by the use of vacuum panels, which distort inwardly under vacuum pressure. Prior art reveals many vertically oriented vacuum panels that allow containers to withstand the rigors of a hot fill procedure. Such vertically oriented vacuum panels generally lie parallel to the longitudinal axis of a container and flex inwardly under vacuum pressure toward this longitudinal axis.

In addition to the vertically oriented vacuum panels, many prior art containers also have flexible base regions to provide additional vacuum compensation. Many prior art containers designed for hot-filling have various modifications to their end-walls, or base regions to allow for as much inward flexure as possible to accommodate at least some of the vacuum pressure generated within the container.

All such prior art, however, provides for flat or inwardly inclined, or recessed base surfaces. These have been modified to be susceptible to as much further inward deflection as possible. As the base region yields to the force, it is drawn into a more inclined position than prior to having vacuum force applied.

Unfortunately, however, the force generated under vacuum to pull longitudinally on the base region is only half that force generated in the transverse direction at the same time. Therefore, vertically oriented vacuum panels are able to react to force more easily than a panel placed in the base. Further, there is a lot more surface area available around the circumference of a container than in the end-wall. Therefore, adequate vacuum compensation can only be achieved by placing vertically-oriented vacuum panels over a substantial portion of the circumferential wall area of a container, typically 60% of the available area.

Even with such substantial displacement of vertically-oriented panels, however, the container requires further strengthening to prevent distortion under the vacuum force.

The liquid shrinkage derived from liquid cooling, causes a build up of vacuum pressure. Vacuum panels deflect toward this negative pressure, to a degree lessening the vacuum force, by effectively creating a smaller container to better accommodate the smaller volume of contents. However, this smaller shape is held in place by the generating vacuum force. The more difficult the structure is to deflect inwardly, the more vacuum force will be generated. In prior art, a substantial amount of vacuum is still present in the container and this tends to distort the overall shape unless a large, annular strengthening ring is provided in horizontal, or transverse, orientation at least a ⅓ of the distance from an end to the container.

Considering this, it has become accepted knowledge to believe that it is impossible to provide for full vacuum compensation through modification to the end-wall or base region alone. The base region offers very little surface area, compared to the side walls, and reacts to force at half the rate of the side walls.

Therefore it has become accepted practice to only expect partial assistance to the overall vacuum compensation to be generated through the base area. Further, even if the base region could provide for enough flexure to accommodate all liquid shrinkage within the container, there would be a significant vacuum force present, and significant stress on the base standing ring. This would place force on the sidewalls also, and to prevent distortion the smooth sidewalls would have to be much thicker in material distribution, be strengthened by ribbing or the like, or be placed into shapes more compatible to mechanical distortion (for example be square instead of circular).

For this reason it has not been possible to provide container designs in plastic that do not have typical prior art vacuum panels that are vertically oriented on the sidewall. Many manufacturers have therefore been unable to commercialize plastic designs that are the same as their glass bottle designs with smooth sidewalls.

U.S. Pat. No. 6,595,380 (Silvers), claims to provide for full vacuum compensation through the base region without requiring positioning of vertically oriented vacuum panels on the smooth sidewalls. This is suggested by combining techniques well-known and practiced in the prior art. Silvers provides for a slightly inwardly domed, and recessed base region to provide further inward movement under vacuum pressure. However, the technique disclosed, and the stated percentage areas required for efficiency are not considered by the present applicant to provide a viable solution to the problem.

In fact, flexure in the base region is recognised to be greatest in a horizontally flat base region, and maximizing such flat portions on the base has been well practiced and found to be unable to provide enough vacuum compensation to avoid also employing vertically oriented vacuum panels.

Silvers does provide for the base region to be strengthened by coupling it to the standing ring of the container, in order to assist preventing unwanted outward movement of the inwardly inclined or flat portion when a heated liquid builds up initial internal pressure in a newly filled and capped container. This coupling is achieved by rib structures, which also serve to strengthen the flat region. Whilst this may strengthen the region in order to allow more vacuum force to be applied to it, the ribs conversely further reduce flexibility within the base region, and therefore reduce flexibility.

It is believed by the present applicant that the specific 'ribbed' method proposed by Silvers could only provide for approximately 35% of the vacuum compensation that is required, as the modified end-wall is not considered capable of sufficient inward flexure to fully account for the liquid shrinkage that would occur. Therefore a strong maintenance of vacuum pressure is expected to occur. Containers employing such base structure therefore still require significant thickening of the sidewalls, and as this is done the base region also becomes thicker during manufacturing. The result is a less flexible base region, which in turn also reduces the efficiency of the vacuum compensation achieved.

The present invention relates to a hot-fill container which is also a development of the hot-fill container described in our international application WO 02/18213 (the earlier PCT specification), which specification is also incorporated herein in its entirety where appropriate.

The earlier PCT specification backgrounds the design of hot-fill containers and the problems with such designs which were overcome or at least ameliorated by the design disclosed in the earlier PCT specification.

In the earlier PCT specification a semi-rigid container was provided that had a substantially vertically folding vacuum panel portion. Such a transversely oriented vacuum panel portion included an initiator portion and a control portion which generally resisted being expanded from the collapsed state.

Further described in the earlier PCT specification is the inclusion of the vacuum panels at various positions along the container wall.

A problem exists when locating such a panel in the end-wall or base region, whereby stability may be compromised if the panel does not move far enough into the container longitudinally to no longer form part of the container touching the surface the container stands on.

A further problem exists when utilizing a transverse panel in the base end-wall due to the potential for shock deflection of the inverted panel when a full and capped container is dropped. This may occur on a container with soft and unstructured walls that is dropped directly on its side. The shock deflection of the sidewalls causes a shock-wave of internal pressure that acts on the panel. In such cases improved panel configurations are desired that further prevent panel roll-out, or initiator region configurations utilized that optimize for resistance to such reversion displacement.

With the current proposal to incorporate vacuum panels into the bottom end wall of the container so that the sidewalls may remain substantially smooth, the vacuum panels in the bottom wall create a handling problem. When these vacuum panels are extended longitudinally to the outwardly inclined position, the container no longer has a flat bottom surface and the container is, therefore, geometrically unstable.

To overcome any instability of the container during the process of filling with liquid, cooling and labelling, it is well practised in prior art to attach a 'base cup' of sorts to the lower end of an unstable container. Attached base cups allow a geometrically unstable container to be supported correctly while the container is transferred through the bottle filling system.

The term "base cup" used hereinafter in respect of the present invention means any holder or holding or transporting means whether in the form of a "cup" or in any other suitable form.

Alberghini, U.S. Pat. No. 4,241,839; Jakobsen, U.S. Pat. No. 4,293,359; Chang U.S. Pat. No. 4,438,856; Nickel U.S. Pat. No. 4,326,638 and many others provide stabilising base cups for containers that are vertically unstable when placed in an upright position. However, in order to process the container of the present invention, whereby force needs to be applied to the bottom end wall, it is necessary to provide an opening through the bottom wall of such a base cup.

Accordingly, there is a need for a system and method of handling containers according to the present invention when the vacuum panel is placed into the geometrically unstable position of being downwardly inclined, whereby stability is imparted to the container, but the vacuum panel is able to be manipulated from one inclination to another.

OBJECTS OF THE INVENTION

In view of the above, it is an object of one preferred embodiment of the present invention to provide a plastic container structure having a transversely oriented pressure panel in its lower portion that can provide for removal of vacuum pressure such that there is substantially no remaining force within the container.

It is a further object of one preferred embodiment of the present invention to provide a container which has a transversely oriented pressure panel that is decoupled to a degree from the adjoining wall such that greater inward and longitudinal movement can be achieved.

It is a further object of one preferred embodiment of the present invention to provide for a container to have a transversely oriented pressure panel that is inwardly displaced to a position above the standing ring of the final container configuration, such that a new base region is formed with a greater standing ring or foot print area, and the pressure panel is substantially protected from top load force applied to the container during commercial distribution.

It is a further object of one preferred embodiment of the present invention to provide for an improved transversely oriented pressure panel having an initiator portion which may utilize essentially the same angle as the control portion, such that greater removal of vacuum pressure can be obtained and such that greater resistance to outward deflection can also be obtained.

It is a further object of one preferred embodiment of the present invention to provide a method of handling a container with a vacuum panel at a bottom surface to provide for the container and a base cup to progress smoothly through the processing line.

A further object of possible embodiments of the invention is to provide a base cup for a container for use in the removal of vacuum pressure from a container.

A further object of one embodiment of the present invention is to provide an improved container handling conveying or processing system.

A further and alternative object of the present invention in all its embodiments, all the objects to be read disjunctively, is to at least provide the public with a useful choice.

SUMMARY OF THE INVENTION

According to one aspect of the present invention there is provided a method of processing a container and base cup structure for removing vacuum pressure, said container having a longitudinal axis and at least one vacuum panel at a bottom end-wall, said vacuum panel being moveable from a downwardly inclined position to an upwardly inclined position, said container having a geometrically unstable configuration when the vacuum panel is in the downwardly inclined position, said container having a geometrically stable configuration when attached to said base cup structure, said method including a system providing:

a container attached or attachable to said base cup said container with said vacuum panel in a downwardly inclined position a conveying means for conveying said container and base cup a first actuating means for applying a longitudinally directed force against said downwardly inclined vacuum panel to move said vacuum panel to an upwardly inclined position.

According to a further aspect of the present invention a method for processing a container and base cup structure for removing vacuum pressure, said container having a longitudinal axis and at least one vacuum panel at a bottom end-wall, said vacuum panel being moveable from an upwardly inclined position to, and from, a downwardly inclined position, said container having a geometrically unstable configuration when the vacuum panel is in the downwardly inclined position, said container having a geometrically stable configuration when attached to said base cup structure, said method including a system providing:

a container attached to said base cup said container with said vacuum panel in an upwardly inclined position a first actuating means for applying a first longitudinally directed force against said upwardly inclined vacuum panel to move said vacuum panel to a downwardly inclined position a conveying means for conveying said container and base cup a second actuating means for applying a second longitudinally directed force against said downwardly inclined vacuum panel to move said vacuum panel to an upwardly inclined position.

According to a further aspect a method for processing a container structure for removing vacuum pressure, said container having a longitudinal axis and at least one vacuum panel at a bottom end-wall, said vacuum panel being moveable from a downwardly inclined position to an upwardly inclined position, said method comprising a system having:

a container with said vacuum panel in a downwardly inclined position a conveyor for conveying said container at least one actuating means for applying a longitudinally directed force against said downwardly inclined vacuum panel to move said vacuum panel to an upwardly inclined position.

Preferably in one embodiment the vacuum panel may include an initiator portion that is decoupled from the adjoining sidewall by an annular region or the like, allowing for increased movement of the panel portion longitudinally away from the previously inclined position, enabling the panel portion to fold inwardly relative to the container and upwardly relative to the base portion.

Preferably in one embodiment the vacuum panel may not include any rib structures which would provide resistance to inverting forces.

Preferably in one embodiment the vacuum panel may include fluting structures or the like to allow at least a substantially even circumferential distribution of folding forces to provide for increased control over folding the panel portion from one inclined position to another and to assist in preventing unwanted return to the original position.

Preferably in one embodiment after folding, the container standing support is provided by a lower part of the container sidewall that provides a replacement container standing support.

According to a further aspect of the invention a method of compensating for a change in pressure in a container as defined in any one of the preceding eight paragraphs is provided in which said method includes applying a force to the or each said panel to cause said folding to occur.

According to a further aspect of this invention there is provided a method of processing a container and base cup structure for removing vacuum pressure and/or apparatus for performing the method substantially as herein described with reference to any one of the embodiments of the accompanying drawings.

According to a further aspect of this invention there is provided a container handling system for handling a container in a processing system, the container having a vacuum panel at or towards a bottom portion thereof and a geometrically stable configuration when the vacuum panel is retracted and a geometrically unstable configuration when the vacuum panel is extended, said container handling system including:

a base cup for holding the container, a first actuating means for moving the vacuum panel of the container to an extended position to increase the volume in the container while the container is supported by the container holder wherein the container is in its geometrically unstable configuration;

a conveying means to convey the base cup to another section of the container processing system, said base cup adapted to hold the container as it is conveyed in its geometrically unstable configuration; and a second actuating means for moving the vacuum panel of the container after it is filled to a retracted position while the container is supported by the base cup wherein the container is returned to its geometrically stable configuration.

According to a further aspect of this invention there is provided a system for processing a plastic container filled with a hot product, including the steps of:

filling a container body with the hot product in a production line, the container body having a projection extending from the container body;

capping the neck of the filled container body with a cap in the next operation of the production line; and pushing the projection extending from the cooled container body into the interior of the container body so that the resultant, filled and cooled container body has one of a reduced vacuum pressure or an increase in container pressure.

Having regard to the need to provide containers that have geometric stability for efficient distribution and processing, a further aspect of this invention provides a method of and/or apparatus for distributing vertically stable containers from the point of bottle manufacture to the filling site.

Geometric stability may be provided in a number of ways, without departing from the scope of the present invention.

The container may be formed with the vacuum panel in the upwardly inclined position. Following ejection from the mould, the container will have a good degree of vertical stability and may be delivered to the processing line in this position.

Equally as well, the container may be blow moulded with the vacuum panel in the downwardly inclined position. In order to achieve geometric stability prior to delivery the vacuum panel may be forced into an upwardly inclined position, for example within the blow mould prior to ejection.

Alternatively, and in a preferred form of the invention, the container may be blow moulded with the vacuum panel in the downwardly inclined position and geometric stability achieved prior to delivery by placing the container within a 'base cup' so the container may be delivered for processing in an upright manner.

To reduce costs associated with the addition of a stabilising base cup, the base cups may be removed from the container after processing and returned to the bottle manufacturer for reuse or recycling.

Further aspects of the invention which should be considered in all its novel aspects will become apparent from the following description.

DETAILED DESCRIPTION OF PREFERRED EMBODIMENTS

Figure 1:
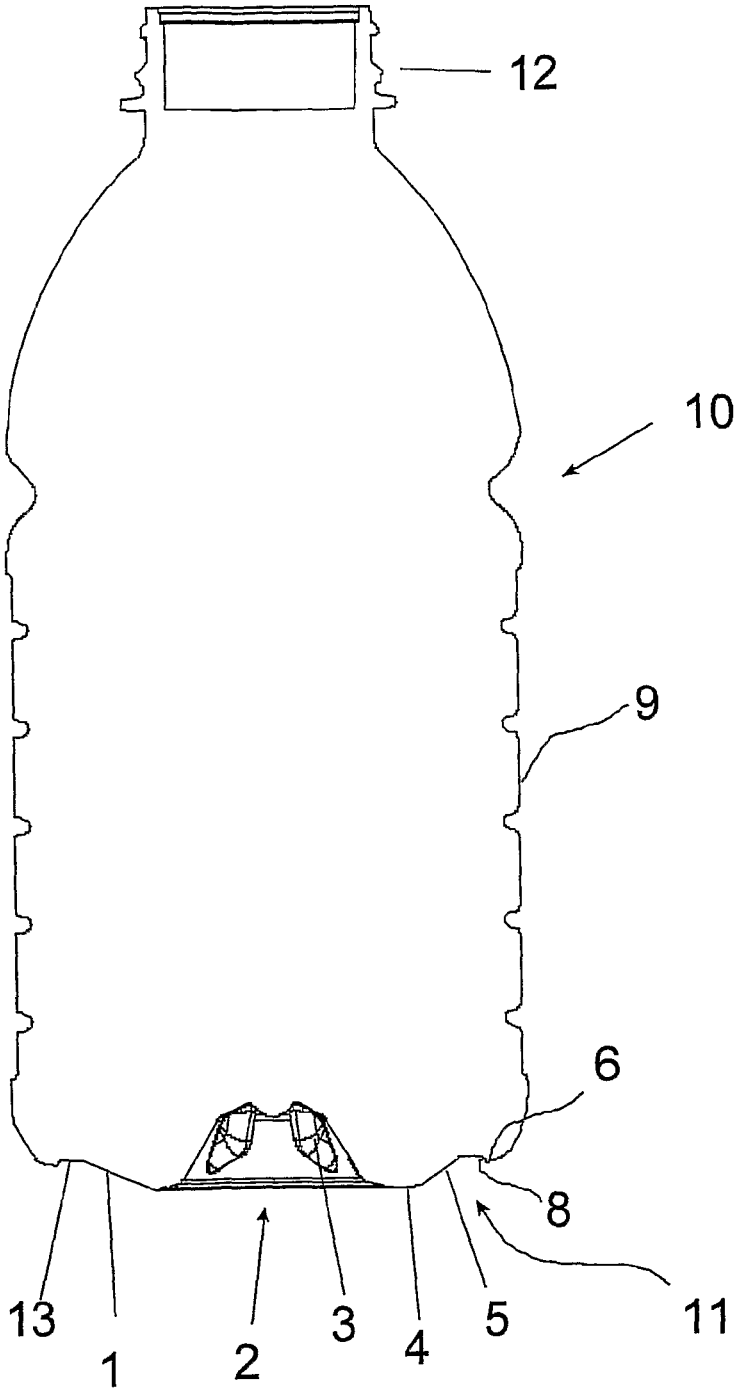
FIG. 1: shows a cross-sectional view of a hot-fill container according to one possible embodiment of the invention in its pre-collapsed condition but without its base cup.

The following description of preferred embodiments is merely exemplary in nature, and is in no way intended to limit the invention or its application or uses.

As discussed above, to accommodate vacuum forces during cooling of the contents within a heat set container, containers have typically been provided with a series of vacuum panels around their sidewalls and an optimized base portion. The vacuum panels deform inwardly, and the base deforms upwardly, under the influence of the vacuum forces. This prevents unwanted distortion elsewhere in the container. However, the container is still subjected to internal vacuum force. The panels and base merely provide a suitably resistant structure against that force. The more resistant the structure the more vacuum force will be present. Additionally, end users can feel the vacuum panels when holding the containers.

Typically at a bottling plant the containers will be filled with a hot liquid and then capped before being subjected to a cold water spray resulting in the formation of a vacuum within the container which the container structure needs to be able to cope with. The present invention relates to hot-fill containers and a structure that provides for the substantial removal or substantial negation of vacuum pressure. This allows much greater design freedom and light weighting opportunities as there is no longer any requirement for the structure to be resistant to vacuum forces which would otherwise mechanically distort the container.

As mentioned above and in the earlier PCT specification, various proposals for hot-fill container designs have been put forward.

Further development of the hot-fill container of the earlier PCT specification has positioned an outwardly inclined and transversely oriented vacuum panel between the lower portion of the side wall and the inwardly domed base region. In this immediate position the container has poor stability, insofar as the base region is very narrow in diameter and does not allow for a good standing ring support. Additionally, there is preferably provided a decoupling structure that provides a hinge joint to the juncture of the vacuum panel and the lower sidewall. This decoupling structure provides for a larger range of longitudinal movement of the vacuum panel than would occur if the panel was coupled to the side wall by way of ribs for example. One side of the decoupling structure remains adjacent the sidewall, allowing the opposite side of the decoupling structure adjacent to an initiator portion to bend inwardly and upwardly. The decoupling structure therefore provides for increased deflection of the initiator portion, allowing increased movement of the panel portion longitudinally away from the previously outwardly inclined position, enabling the panel portion to fold inwardly relative to the container and upwardly relative to the initial base position. The lower sidewall is therefore subjected to lower force during such inversion. During this action, the base portion is translated longitudinally upward and into the container.

Further, as the panel portion folds inwardly and upwardly, the decoupling structure allows for the vacuum panel to now form part of the container base portion. This development has at least two important advantages.

Firstly, by providing the vacuum panel so as to form part of the base after folding, a mechanical force can now be provided immediately against the panel in order to apply inverting force. This allows much greater control over the action, which may for example be applied by a mechanical pusher, which would engage with the container base in resetting the container shape. This allows increased design options for the initiator portion.

Secondly, the transversely oriented vacuum panel is effectively completely removed from view as it is forced from an outward position to an inward position. This means that there are no visible design features being imposed on the major portion of the side wall of the container in order to incorporate vacuum compensation. If required therefore, the major portion of the side wall of the present invention could have no structural features and the container could, if required, replicate a clear wall glass container. Alternatively, as there will be little or no vacuum remaining in the container after the panel is inverted, any design or shape can now be utilized, without regard for integrity against vacuum forces found in other hot-fill packages.

Such a manoeuvre allows for a wide standing ring to be obtained. The decoupling structure provides for the panel to become displaced longitudinally so that there is no contact between any part of the panel or upwardly domed base portion with the contact surface below. A standing ring is then provided by the lower sidewall immediately adjacent the decoupling structure.

Further, by gaining greater control over the inverting motion and forces, it is possible to allow the initiator portion to share the same steep angle as the control portion. This allows for increased volume displacement during inversion and increased resistance to any reversion back to the original position.

Referring to the accompanying drawings, FIG. 1 shows, by way of example only, and in a diagrammatic cross sectional view, a container in the form of a bottle. This is referenced generally by arrow 10 with a typical neck portion 12 and a side wall 9 extending to a lower portion of the side wall 11 and an underneath base portion 2.

The container 10 will typically be blow moulded from any suitable plastics material but typically this will be polyethylene terephthalate (PET).

The base 2 is shown provided with a plurality of reinforcing ribs 3 so as to form the typical "champagne" base although this is merely by way of example only. A base cup for the base 2 is not illustrated in this Figure.

In FIG. 1 the lower side wall portion 11, which operates as a pressure panel, is shown in its unfolded position so that a ring or annular portion 6 is positioned above the level of the bottom of the base 2 which is forming the standing ring or support 4 for the container 10.

Figure 2:
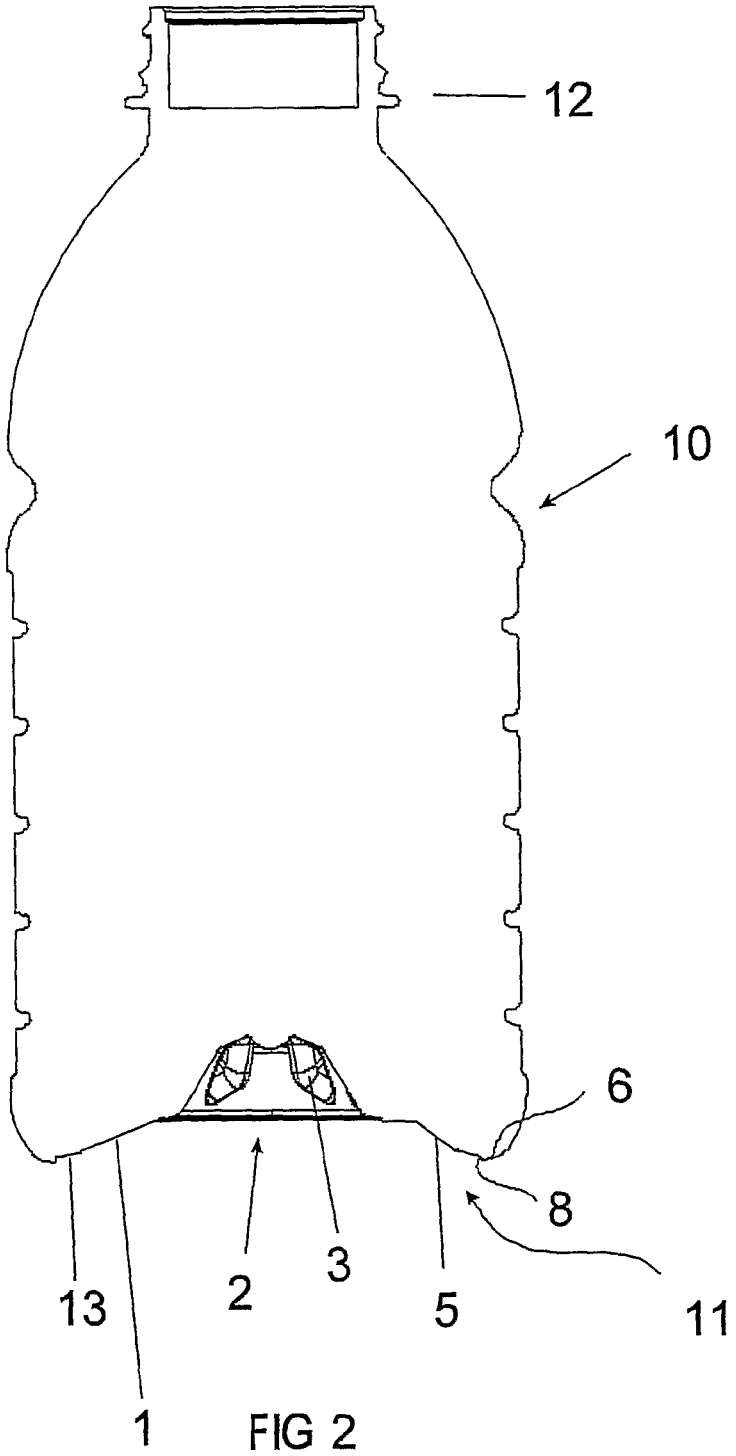
FIG. 2: shows the container of FIG. 1 in its collapsed position.

In FIG. 2 the lower side wall portion 11 is shown having folded inwardly so that the ring or annular portion 6 is positioned below the level of the bottom of the base 2 and is forming the new standing ring or support for the container 10.

Figure 3:
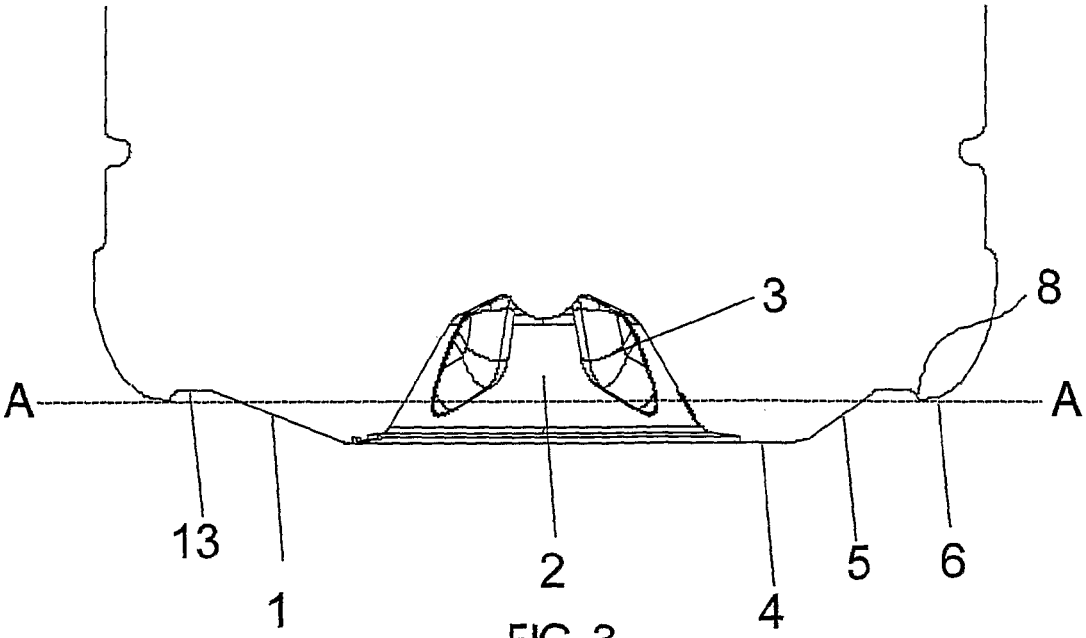
FIG. 3: shows the base of FIG. 1 before collapsing.
Figure 4:
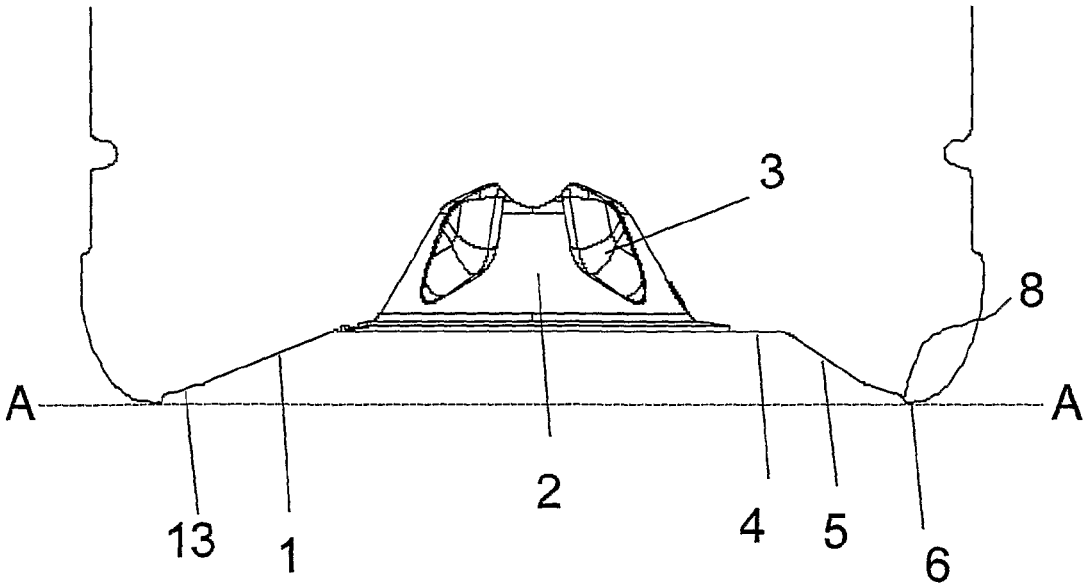
FIG. 4: shows the base of FIG. 2 following collapsing.

To assist this occurring, and as will be seen particularly in FIGS. 3 and 4, immediately adjacent the ring or annular portion 6 there may be an instep or recess 8 and decoupling structure 13, in this case a substantially flat, non-ribbed region, which after folding enables the base portion 2 to effectively completely disappear within the bottom of the container and above the line A-A. Many other configurations for the decoupling structure 13 are envisioned, however.

Figure 5:
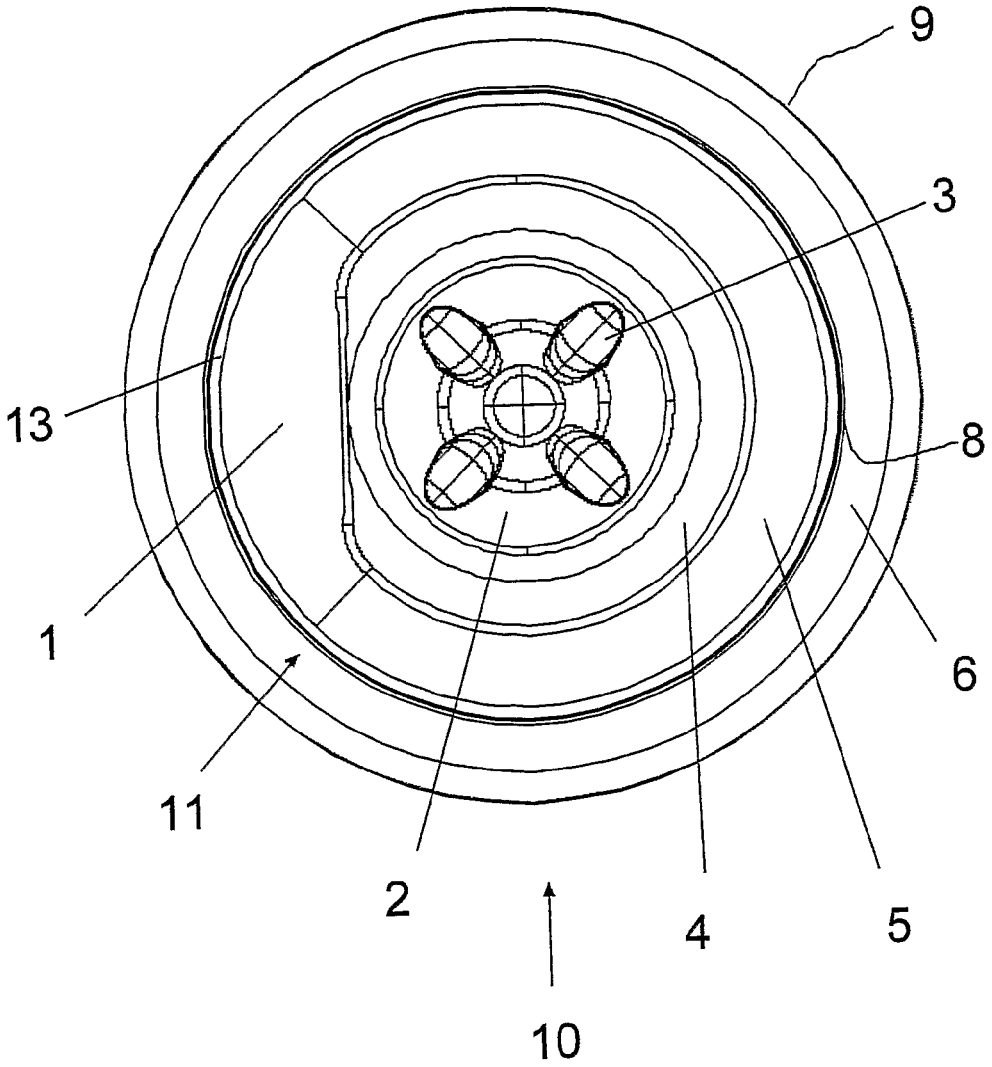
FIG. 5: shows an underneath view of the base of the container of FIG. 1 before collapsing.

Referring now particularly to FIG. 5, the base 2 with its strengthening ribs 3 is shown surrounded by the bottom annular portion 11 of the side wall 9 and the annular structure 13. The bottom portion 11 is shown in this particular embodiment as having an initiator portion 1 which forms part of the collapsing or inverting section which yields to a longitudinally-directed collapsing force before the rest of the collapsing or folding section.

The base 2 is shown provided within the typical base standing ring 4, which will be the first support position for the container 10 prior to the inversion of the folding panel.

Associated with the initiator portion 1 is a control portion 5 which in this embodiment is a more steeply angled inverting section which will resist expanding from the collapsed state.

Forming the outer perimeter of the bottom portion 11 of the side wall 9 is shown the side wall standing ring or annular portion 6 which following collapsing of the panel 11 will provide the new container support.

Figure 6:
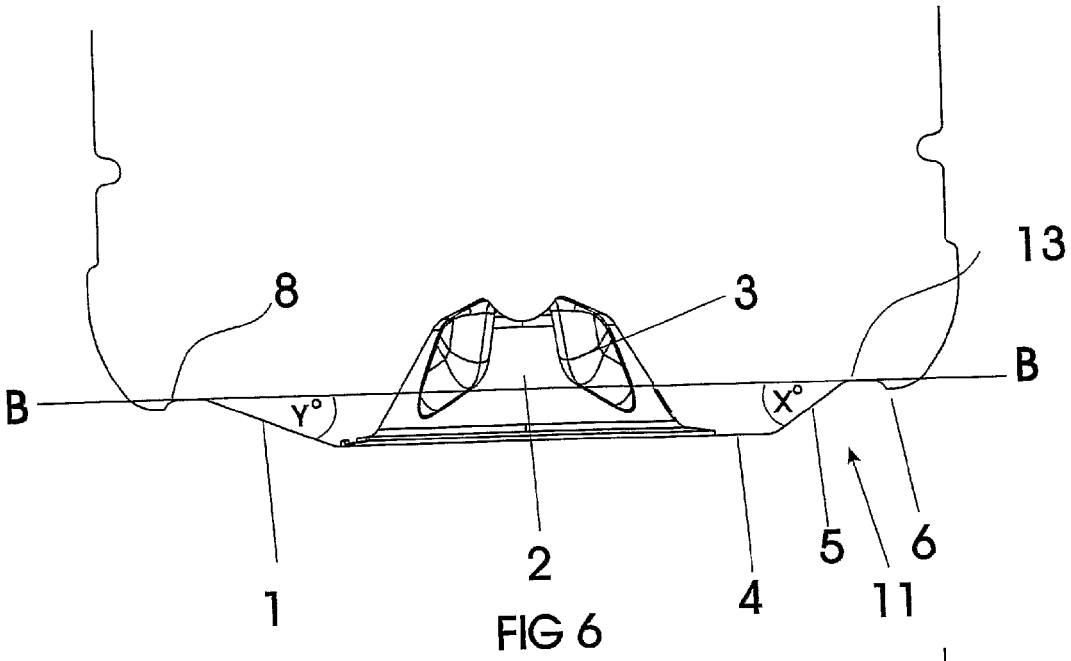
FIG. 6: shows the base of FIG. 1 before collapsing.

To allow for increased evacuation of vacuum it will be appreciated that it is preferable to provide a steep angle to the control portion 5 of the pressure panel 11. As shown in FIG. 6 the panel control portion 5 is generally set with an angle, X°, varying between 30 degrees and 45 degrees. It is preferable to ensure an angle is set above 10 degrees at least. The initiator portion 1 may in this embodiment have a lesser angle, Y°, of perhaps at least 10 degrees less than the control portion.

By way of example, it will be appreciated that when the panel 11 is inverted by mechanical compression it will undergo an angular change that is double that provided to it. If the conical control portion 5 is set to 10 degrees it will provide a panel change equivalent to 20 degrees. At such a low angle it has been found to provide an inadequate amount of vacuum compensation in a hot-filled container. Therefore it is preferable to provide much steeper angles.

Figure 7:
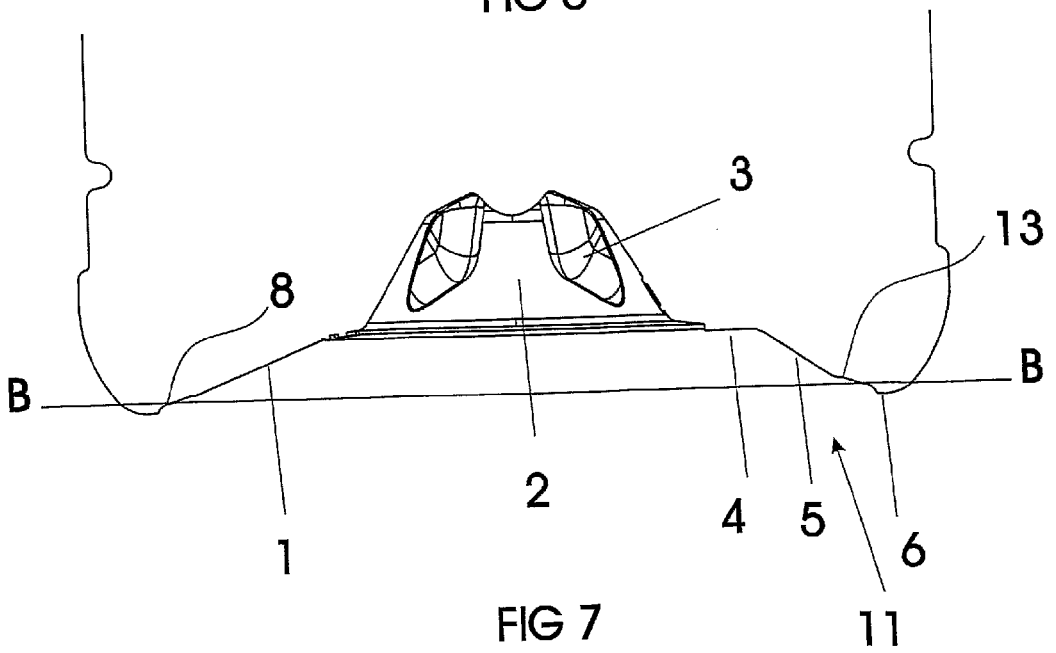
FIG. 7: shows the base of FIG. 2 following collapsing.

Referring to FIGS. 6 and 7, it will be appreciated that the control portion 5 may be initially set to be outwardly inclined by approximately 35 degrees and will then provide an inversion and angle change of approximately 70 degrees. The initiator portion may in this example be 20 degrees.

Figure 8A:
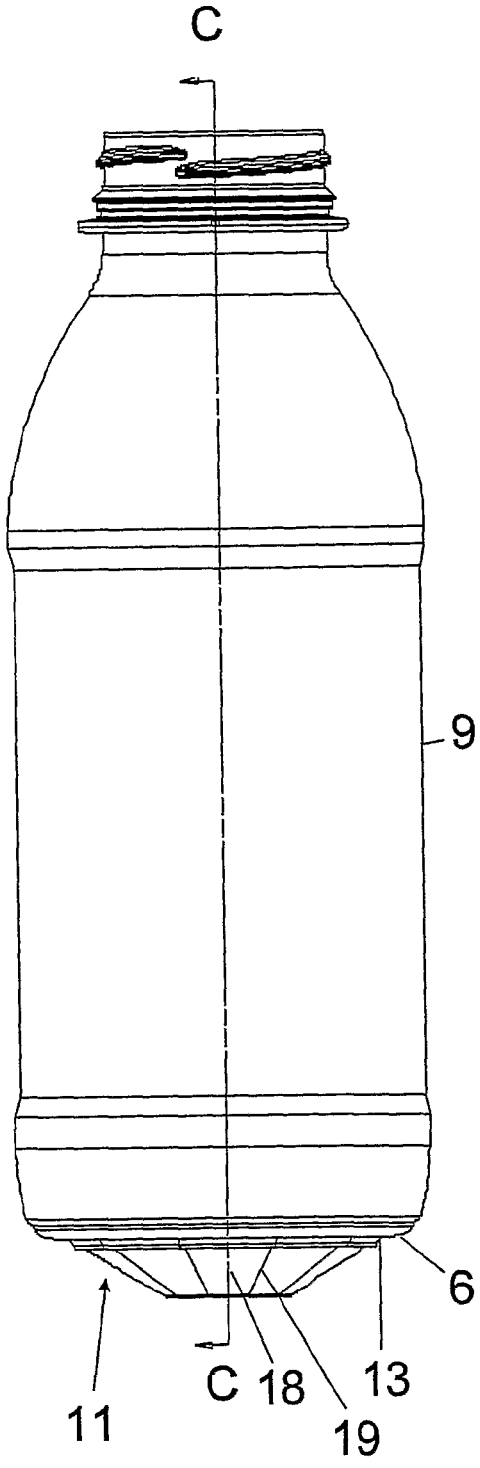
FIG. 8*a*: shows a cross-sectional view of a hot-fill container according to an alternative embodiment of the invention in its pre-collapsed condition but without its base cup.
Figure 8B:
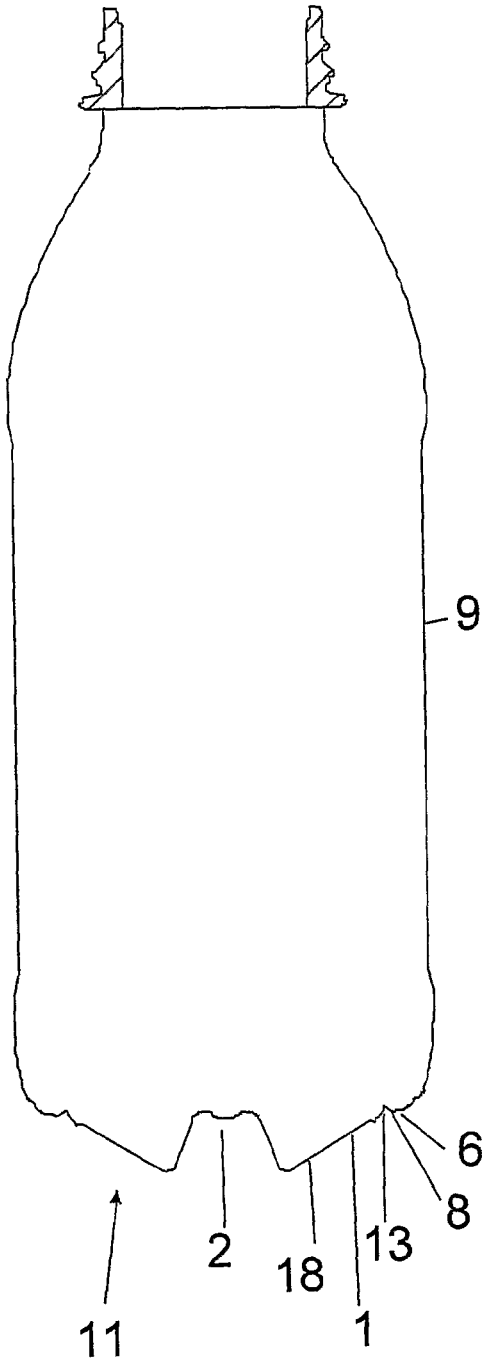
FIG. 8*b*: shows a cross-sectional view of the container shown in FIGS. 8*b* and 9 through line C-C

Referring to FIGS. 8*a* and 8*b*, where the same reference numerals have been used where appropriate as previously, it is envisaged that in possible embodiments of this invention the initiator portion may be reconfigured so that control portion 18 would provide essentially a continuous conical area about the base 2.

The initiator portion 1 and the control portion 5 of the embodiment of the preceding figures will now be at a common angle, such that they form a uniformly inclined panel portion.

However, initiator portion 1 may still be configured to provide the area of least resistance to inversion, such that although it shares the same angular extent as the control portion 18, it still provides an initial area of collapse or inversion. In this embodiment, initiator portion 1 causes the pressure panel 11 to begin inversion from the widest diameter adjacent the decoupling structure 13.

Figure 9:
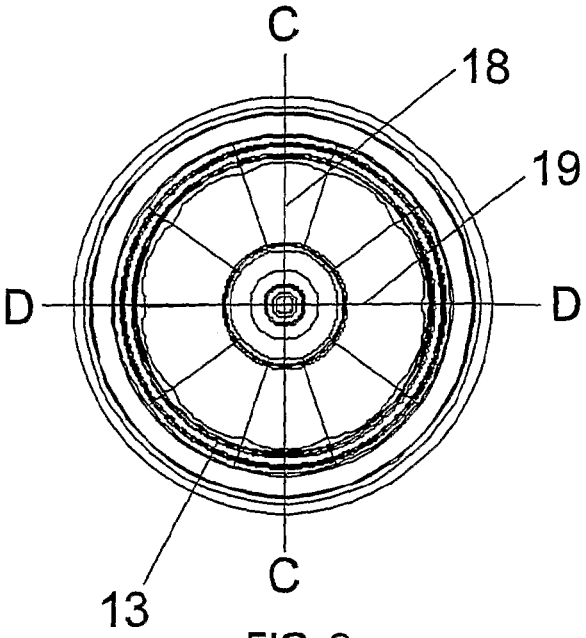
FIG. 9: shows an underneath view of the base of the container of FIGS. 8*a* and 8*b* and FIG. 10 before collapsing
Figure 10:
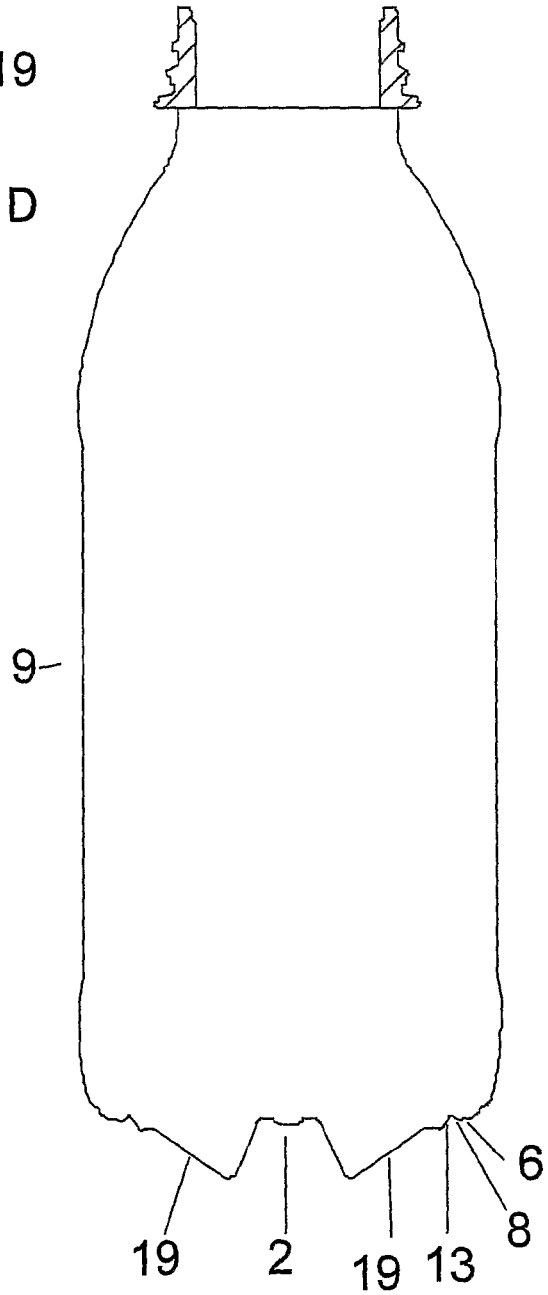
FIG. 10: shows a cross-sectional view of the container shown in FIG. 9 through line D-D

In this embodiment the container side walls 9 are 'glass-like' in construction in that there are no additional strengthening ribs or panels as might be typically found on a container, particularly if required to withstand the forces of vacuum pressure. Additionally, however, structures may be added to the conical portions of the vacuum panel 11 in order to add further control over the inversion process. For example, the conical portion of the vacuum panel 11 may be divided into fluted regions. Referring to FIGS. 8*a* and 9 especially, panel portions that are convex outwardly, and evenly distributed around the central axis create regions of greater angular set 19 and regions of lesser angular set 18, may provide for greater control over inversion of the panel. Such geometry provides increased resistance to reversion of the panel, and a more even distribution of forces when in the inverted position.

Referring to FIGS. 15*a-c* and 17*a-d*, convex or downwardly outwardly projecting flutes are shown.

Concave or inwardly directed fluting arrangements are also envisioned, in addition to outwardly directed flutes. Inwardly directed flutes offer less resistance to initial inverting forces, coupled with increased resistance to reverting back out to the original position. In this way they behave in much the same manner as ribs to prevent the panel being forced back out to the outwardly inclined position, but allow for hinge movement from the first outwardly inclined position to the inwardly inclined position. Such inwardly or outwardly directed flutes or projections function as ribs to increase the force required to invert the panel. It will be appreciated that the mechanical action applied to invert the panel will be sufficient to overcome any rib-strengthened panel, and when the mechanical action is removed the rib-strengthened panel, for example by strong flutes, will be very resistant to reversion to the original position if the container is dropped or shocked.

Figure 16A:
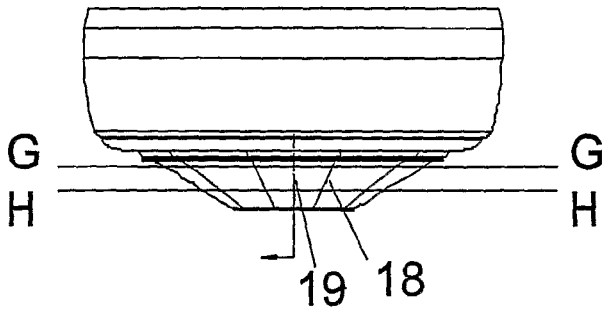
FIG. 16*a*: shows a side view of a container of FIG. 16*c* according to an alternative embodiment including inwardly projecting fluting through Line I-I but without a base cup.
Figure 16B:
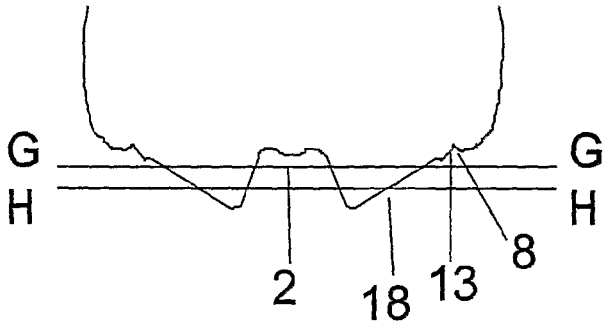
FIG. 16*b*: shows a cross-sectional view of the base of the container of FIG. 16*c* through Line J-J.
Figure 16C:
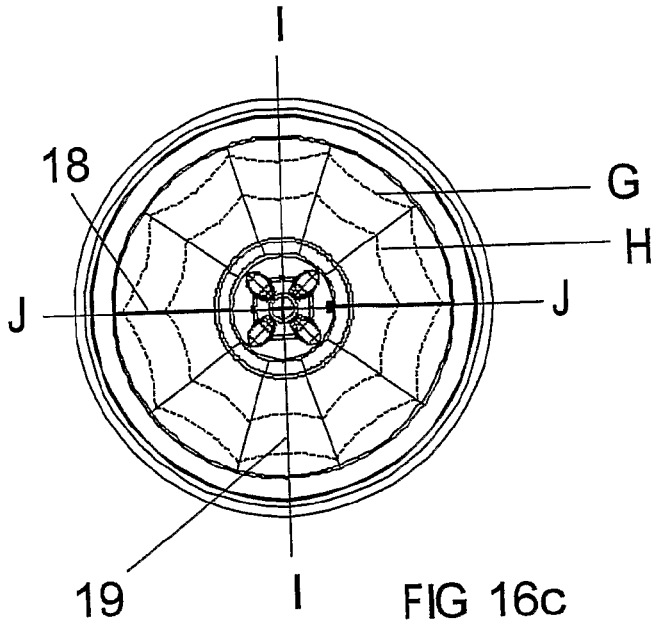
FIG. 16*c*: shows an underneath view of the base of the container of FIGS. 16*a* and 16*b* with dotted contour section lines through lines G-G and H-H.
Figure 16D:
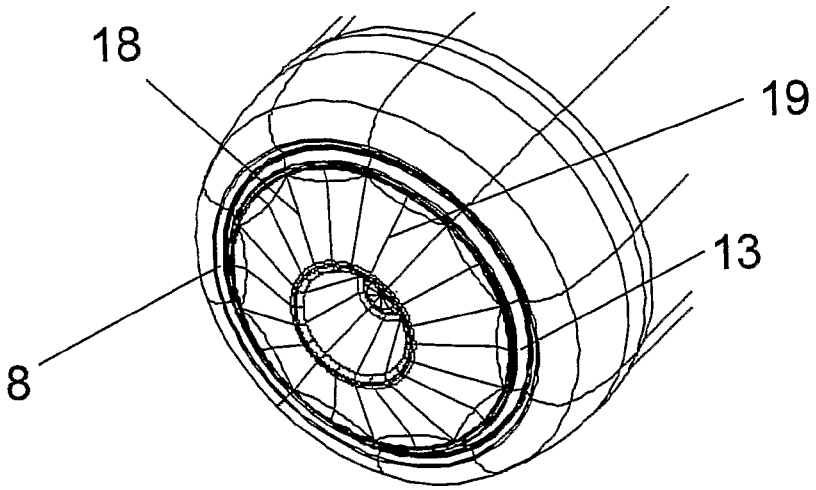
FIG. 16*d*: shows a perspective view of the base of the container of FIGS. 16*a-c;*
Figure 17A:
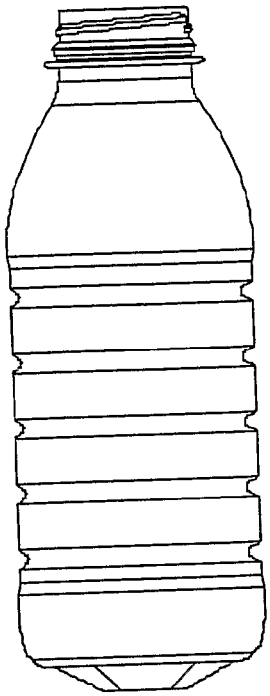
FIGS. 17*a-d*: show side, side perspective, end perspective and end views respectively of the container of FIG. 15.
Figure 17B:
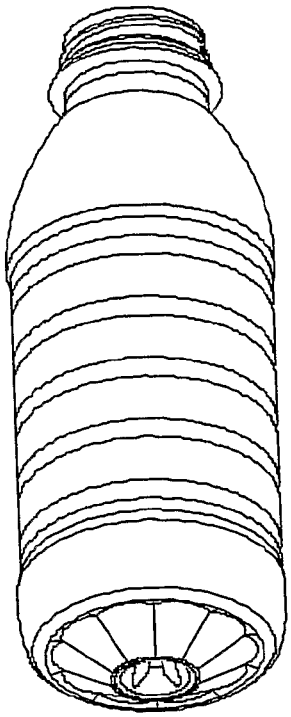
Figure 17C:
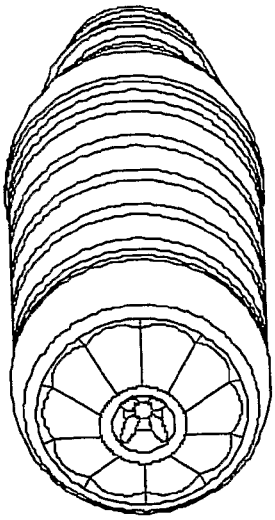
Figure 17D:
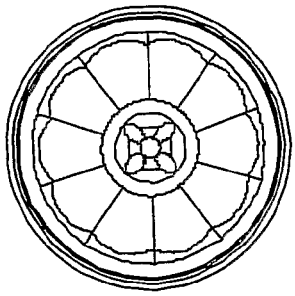
Figure 18A:
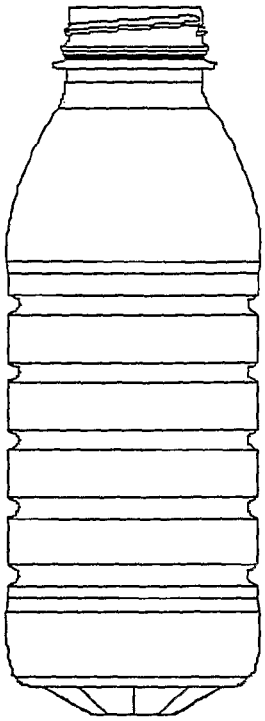
FIGS. 18*a-d*: show side, side perspective, end perspective and end views respectively of the container of FIG. 16.
Figure 18B:
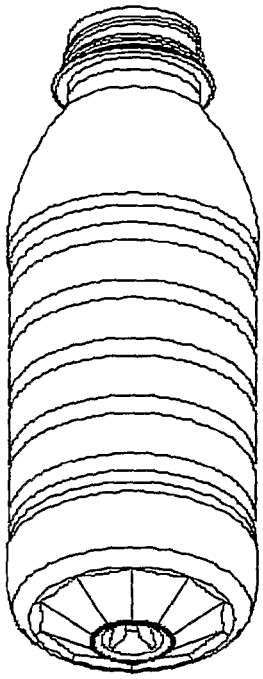
Figure 18C:
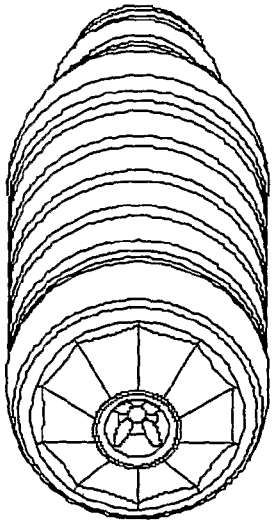
Figure 18D:
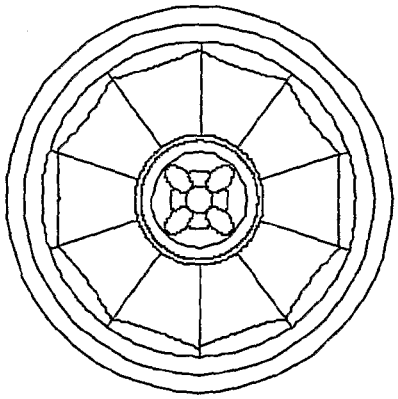

Referring to FIGS. 16*a-d* and 18*a-d*, concave or upwardly inwardly projecting flutes are shown, the contour lines G and H of FIG. 16*c* illustrating this concavity through two cross-sectional reliefs.

Further embodiments comprising arrays utilizing both concave and convex flutes are also intended within the scope of the invention.

Figures 11A, 11B, 11C, 11D:
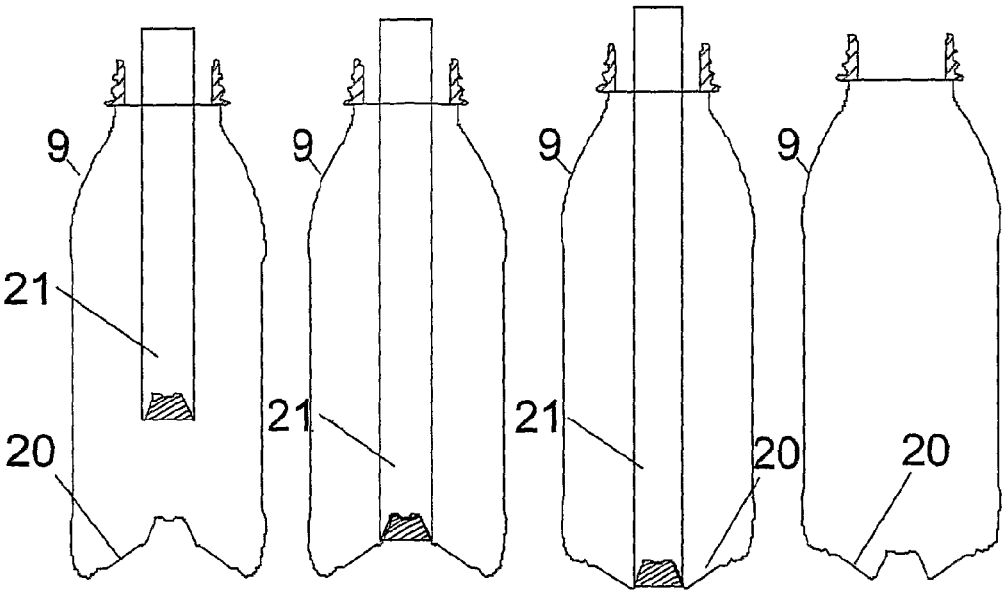
FIGS. 11*a-d*: show cross-sectional views of the container according to an alternative embodiment of the invention incorporating a pusher to provide panel folding but without a base cup.
Figures 12A, 12B, 12C, 12D:
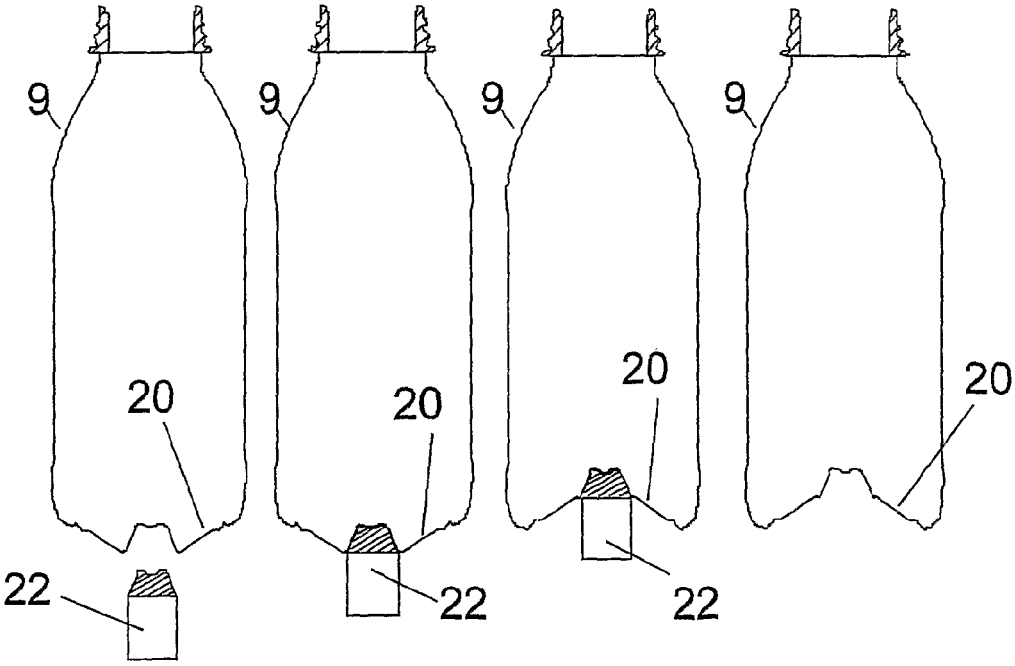
FIGS. 12*a-d*: show cross-sectional views of the container according to a further alternative embodiment of the invention incorporating a pusher to provide panel folding but without a base cup.

In the embodiment as shown in FIGS. 11*a-d*, the container may be blow moulded with the pressure panel 20 in the inwardly or upwardly inclined position. A force could be imposed on the folding panel 20 such as by means of a mechanical pusher 21 introduced through the neck region and forced downwardly in order to place the panel in the outwardly inclined position prior to use as a vacuum container for example, as shown in FIG. 11*d*.

In such an embodiment as shown in FIGS. 12*a-d*, following the filling and capping of the bottle and the use of cold water spray creating the vacuum within the filled bottle, a force could be imposed on the folding panel 20 such as by means of a mechanical pusher 22 or the creation of some relative movement of the bottle base relative to a punch or the like, in order to force the panel 20 from an outwardly inclined position to an inwardly inclined position. Any deformation whereby the bottle shape was distorted prior to inversion of the panel 20 would be removed as internal volume is forcibly reduced. The vacuum within the container is removed as the inversion of the panel 20 causes a rise in pressure. Such a rise in pressure reduces vacuum pressure until ambient pressure is reached or even a slightly positive pressure is achieved.

It will be appreciate that in a further embodiment of the invention the panel may be inverted in the manner shown in FIGS. 12*a-d* in order to provide a panel to accommodate internal force such as is found in pasteurization and the like. In such a way the panel will provide relief against the internal pressure generated and then be capable of accommodating the resulting vacuum force generated when the product cools down.

In this way, the panel will be inverted from an upwardly inclined position FIGS. 11*a* to 11*b* to a downwardly inclined position as shown in FIGS. 12*a-d*, except that the mechanical action is not provided. The force is instead provided by the internal pressure of the contents.

Referring again to FIGS. 12*a-d* it will be seen that by the provision of the folding portion 20 in the bottom of the side wall 9 of the container 10 the major portion of the side wall 9 could be absent any structural features so that the container 10 could essentially replicate a glass container if this was required.

Although particular structures for the bottom portion of the side wall 9 is shown in the accompanying drawings it will be appreciated that alternative structures could be provided. For example a plurality of folding portions could be incorporated about the base 2 in an alternative embodiment.

There may also be provided many different decoupling or hinge structures 13 without departing from the scope of the invention. With particular reference to FIGS. 6 and 7, it can be seen that the side of the decoupling structure 13 that is provided for the pressure panel 11 may be of an enlarged area to provide for increased longitudinal movement upwards into the container following inversion.

Figure 13:
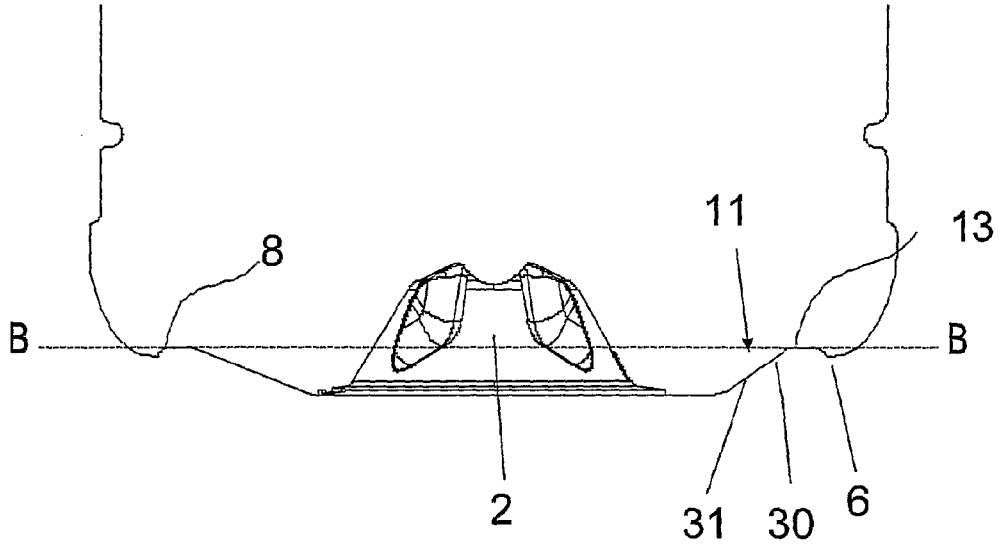
FIG. 13: shows the base of an alternative embodiment of the invention before collapsing but without a base cup.
Figure 14:
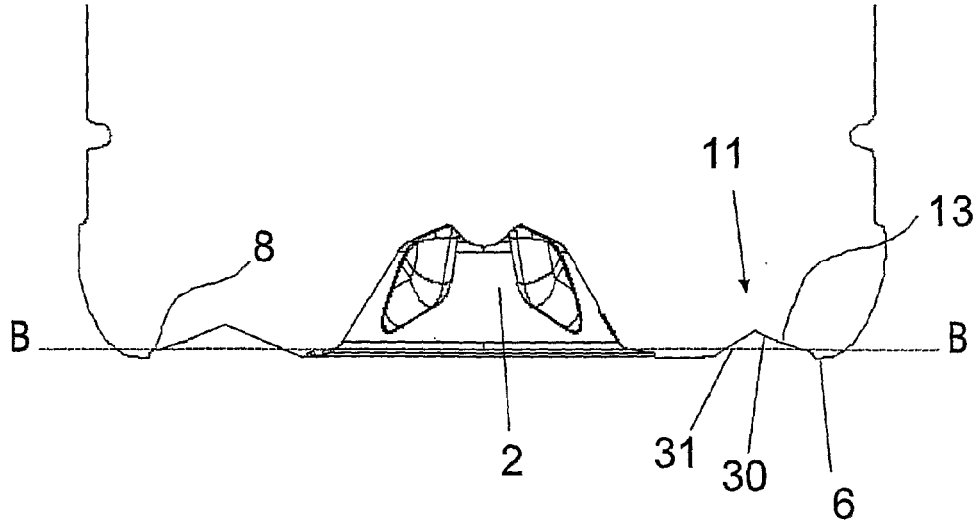
FIG. 14: shows the base of FIG. 13 during the initial stages of collapsing.
Figure 15A:
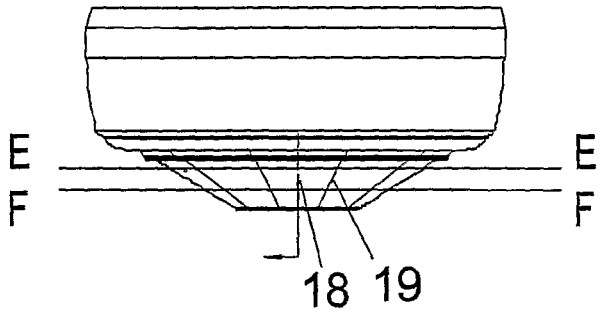
FIGS. 15*a-b*: show side and cross-sectional views of the container shown in FIG. 9 including outwardly projecting fluting but without a base cup.
Figure 15B:
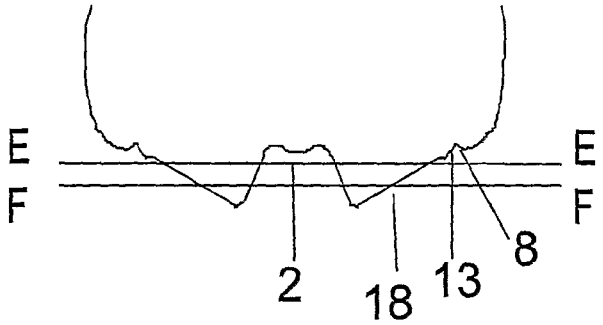
Figure 15C:
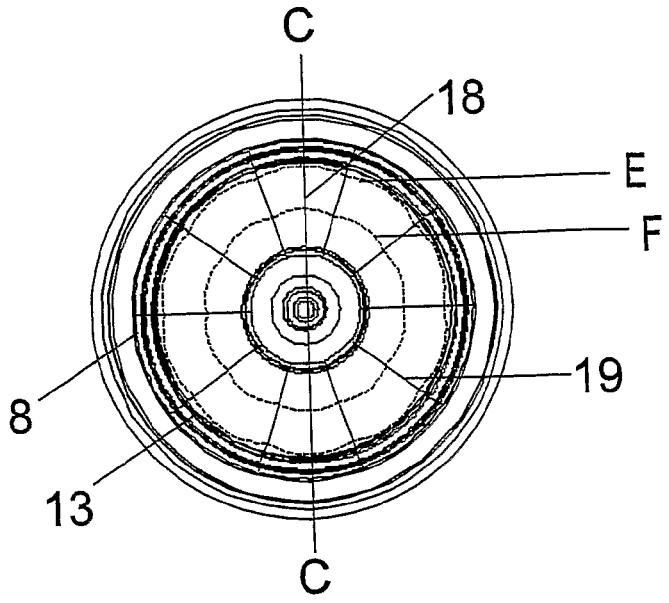
FIG. 15*c*: shows an underneath view of the base of the container of FIGS. 15*a* and 15*b* with dotted contour section lines through lines E-E and F-F.
Figure 15D:
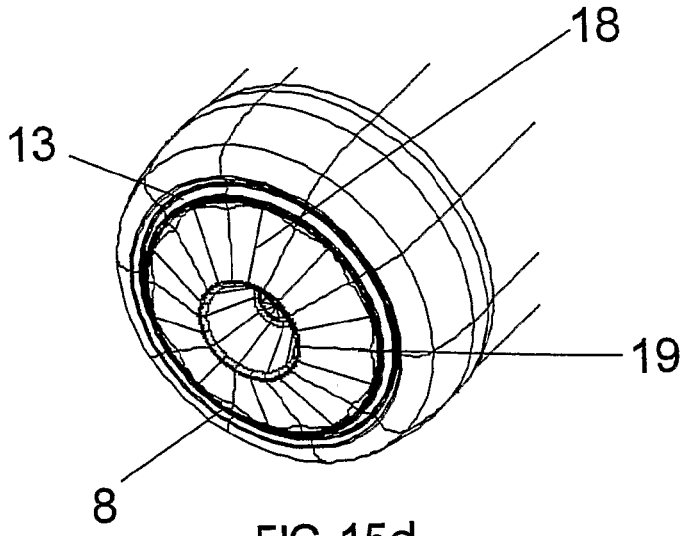
FIG. 15*d*: shows a perspective view of the base of the container of FIGS. 15*a-c;*

In a further embodiment of the present invention, and referring to FIGS. 13 and 14, it can be seen that the widest portions 30 of the pressure panel 11 may invert earlier than the narrower portions 31. The initiator portion may be constructed with this in mind, to allow for thinner material and so on, to provide for the panel 11 to begin inverting where it has the greater diameter, ahead of the narrower sections of the panel. In this case the portion 30 of the panel, which is radially set more distant from the central axis of the container inverts ahead of portion 31 to act as the initiator portion.

Having regard for the need to provide a container handling system to impart vertical stability to the container while in a geometrically unstable state, a further aspect of this invention provides a handling system that can handle containers that have geometrically unstable configurations and further process the containers in their geometrically unstable configuration and then return them to a geometrically stable configuration so that they can then be handled using conventional conveying systems or the like.

As previously stated, the container may be delivered from the bottle manufacturer with the vacuum panel either in the upwardly inclined position or the downwardly inclined position.

One embodiment of the present invention provides for the container to be placed inside a modified version of a typical 'base cup' while progressing through the processing line, allowing for the vacuum panel to be placed in either position for delivery.

The container handling system includes at least one mechanical actuator for forcing the vacuum panel from one position to another, and for removal of the base cup if desired.

A preferred form of the present invention provides for the container to be manufactured with the vacuum panel in the downwardly inclined position and be placed immediately into a base cup to provide vertical stability.

According to this preferred aspect of the present invention, the filling line of the processing system preferably includes only one actuator moving the vacuum panel from a downwardly inclined position to an upwardly inclined position.

The single actuator of this aspect may also be designed to remove the base cup after activating the vacuum panel, as the container will no longer require the base cup. Geometric stability is achieved once the vacuum panel has been moved to the upwardly inclined position. By removing the base cup, the base cups may be recovered and returned to the location for reuse on other containers. This reduces cost by enabling material recovery, and also reduces any negative marketing impact resulting from delivery of containers with unsightly base cups attached.

Figure 19:
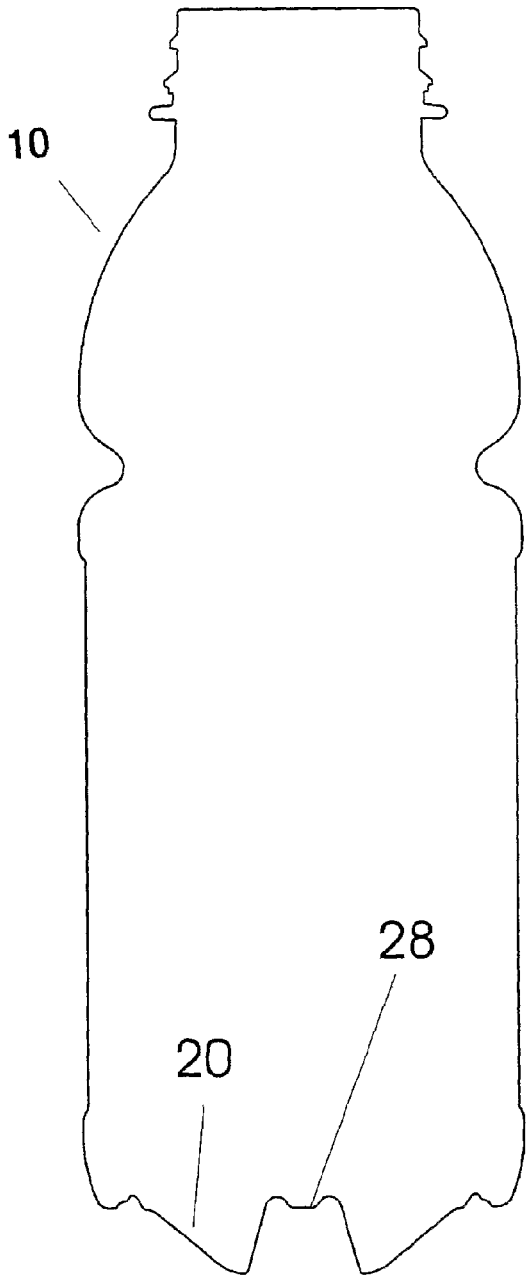
FIG. 19: shows a cross-sectional side view of a container according to a further embodiment of the invention but without a base cup.
Figure 20:
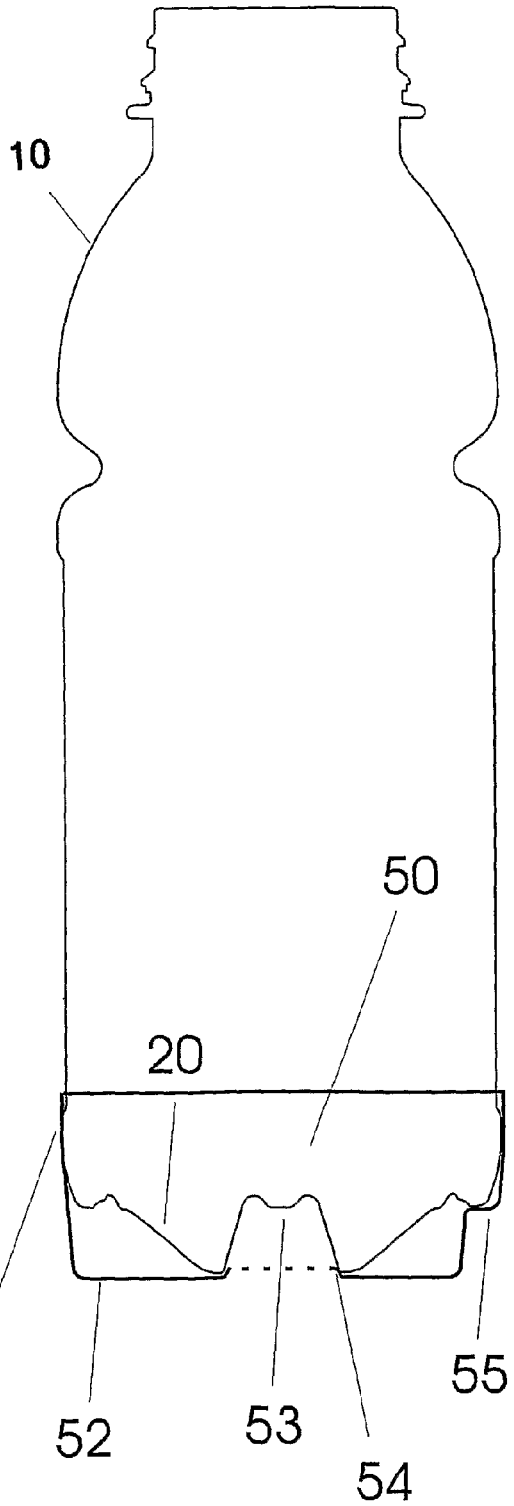
FIG. 20: shows a cross-sectional side view of the container of FIG. 19 with a base cup according to a further embodiment of the invention.
Figure 21A:
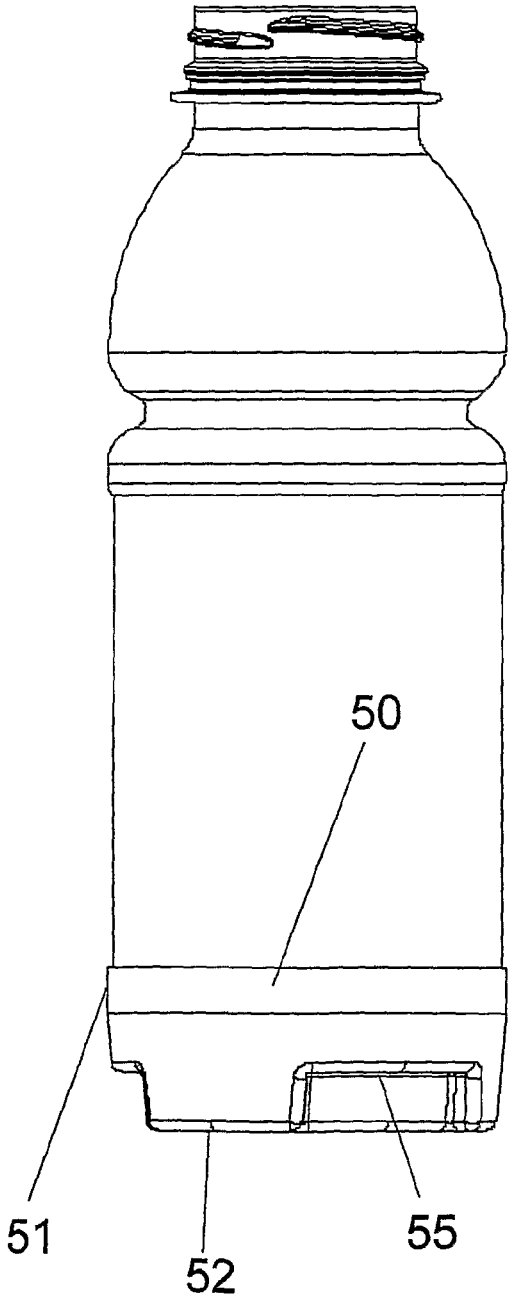
FIGS. 21*a-b*: show side and side perspective views of the container and base cup of FIG. 20.
Figure 21B:
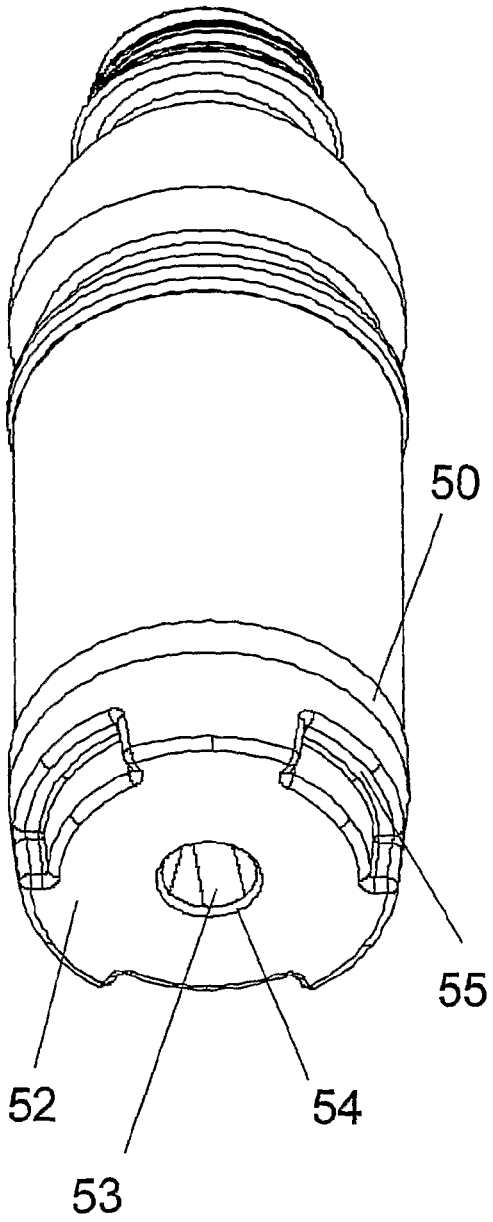
Figure 22A:
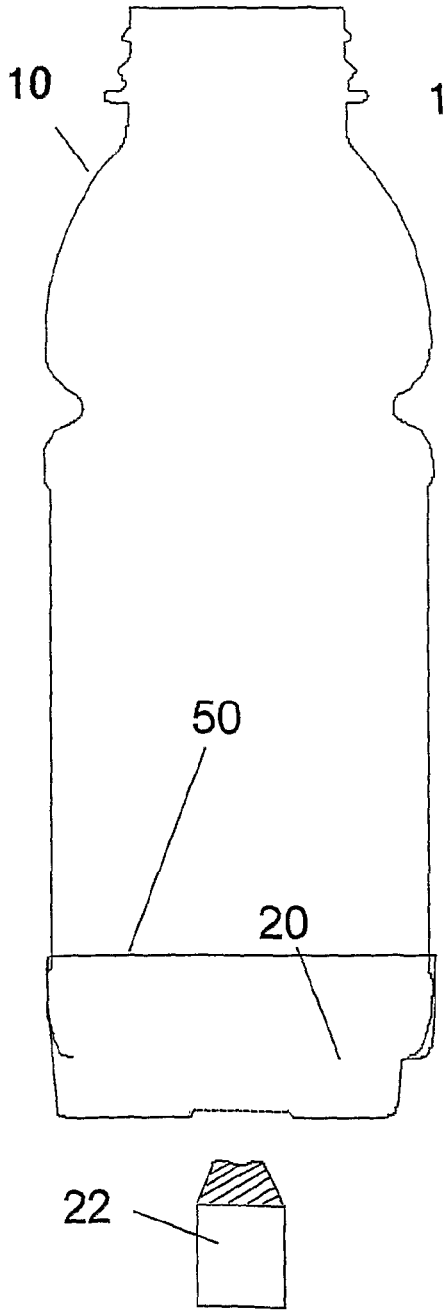
FIG. 22*a-d*: show side cross-sectional views of the container of FIG. 20 according to a further alternative embodiment of the invention incorporating a pusher to provide panel folding.
Figure 22B:
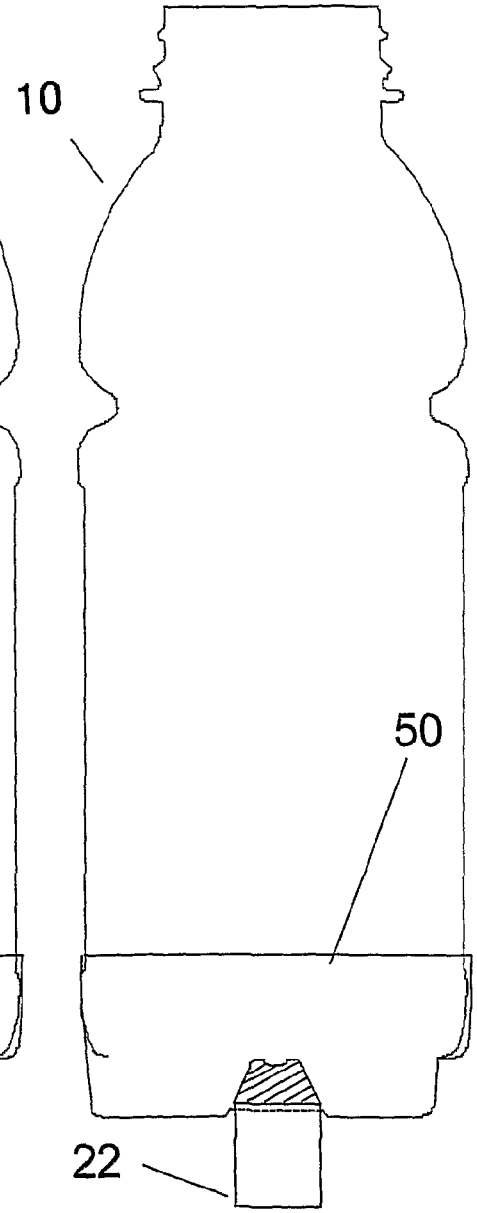
Figure 22C:
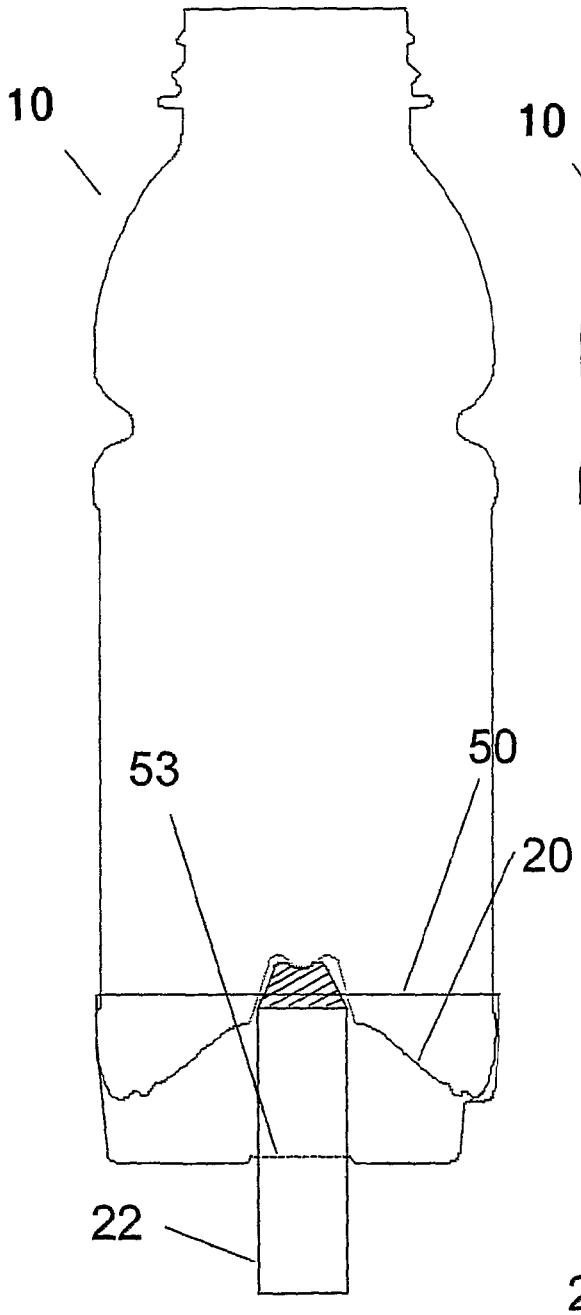
Figure 22D:
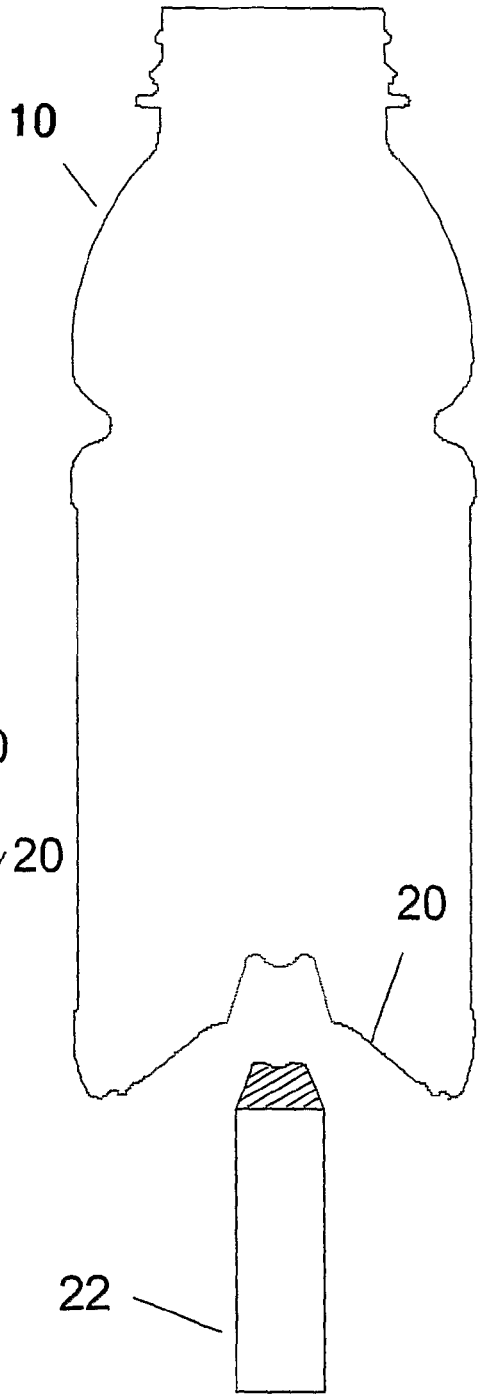
Figure 23A:
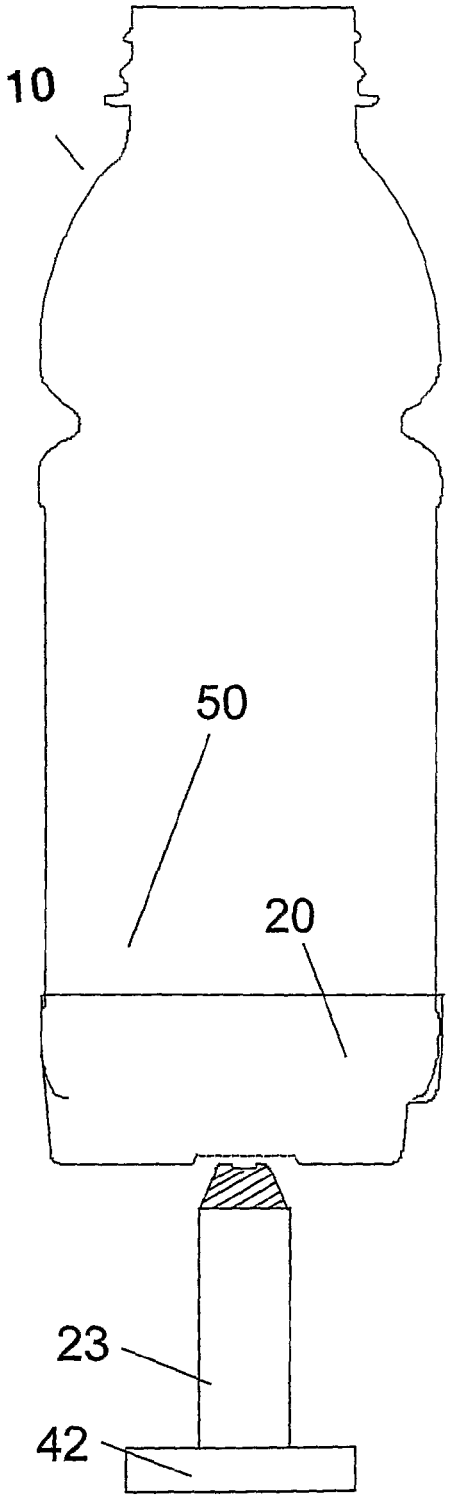
FIG. 23*a-d*: show side cross-sectional views of the container of FIG. 20 according to a further alternative embodiment of the invention incorporating an alternative pusher to provide panel folding.
Figure 23B:
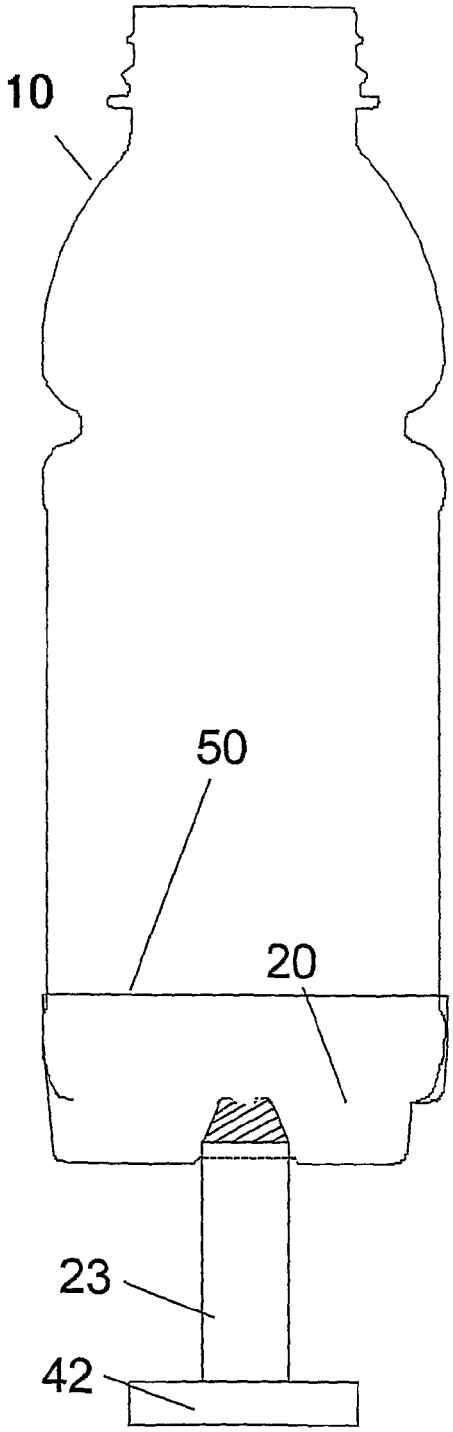
Figure 23C:
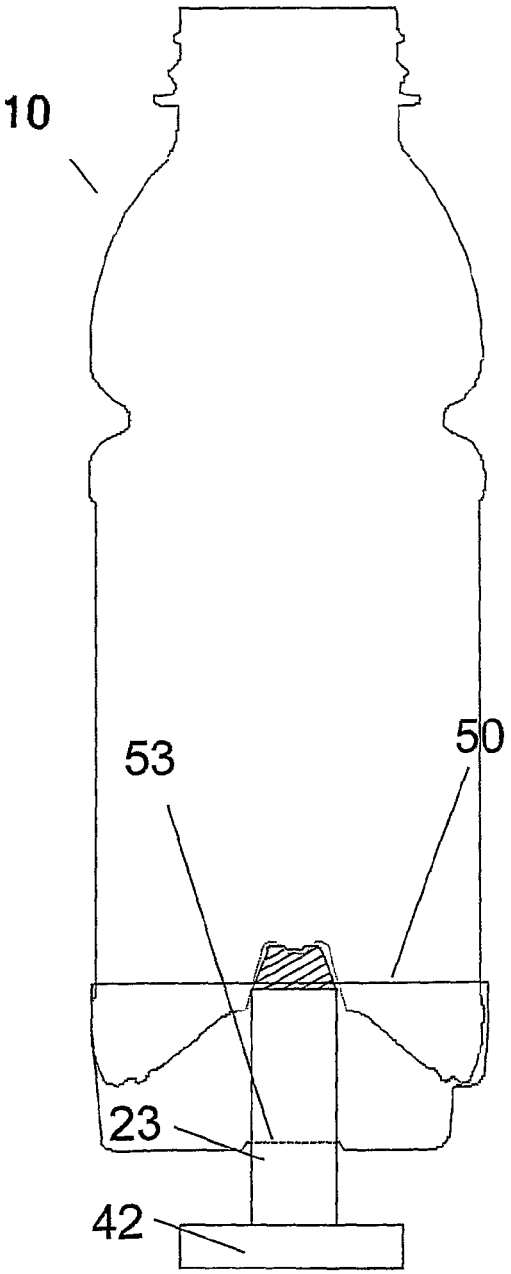
Figure 23D:
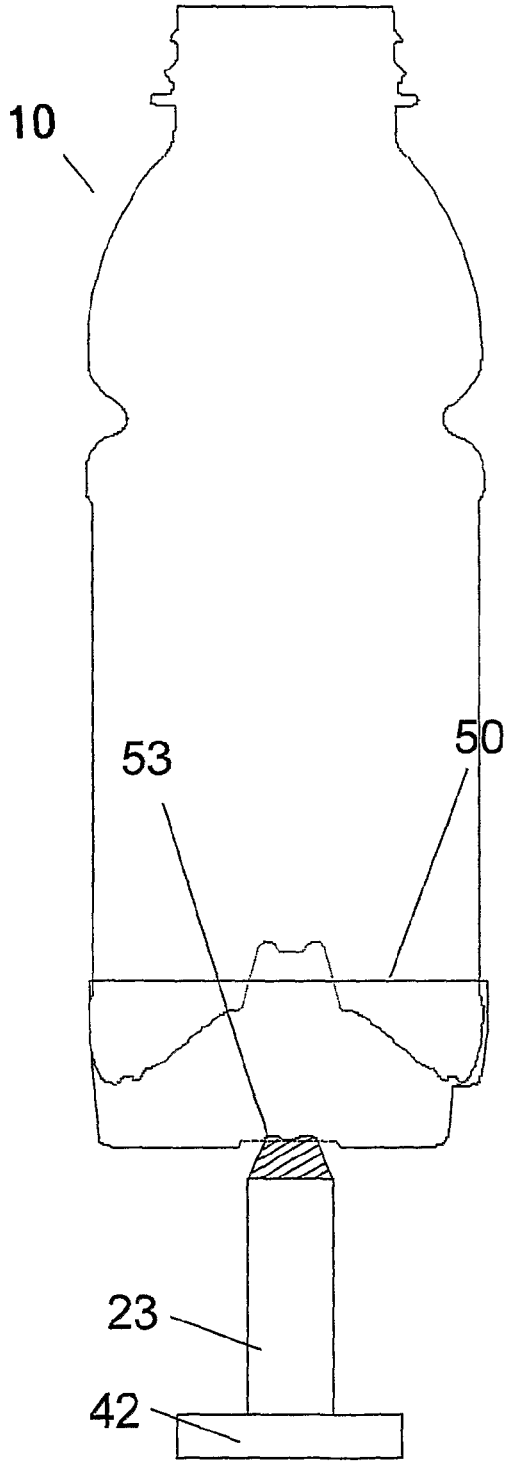

FIGS. 19-21 *a-b* illustrate a typical container with the vacuum panel 20 in the downwardly inclined position with a base cup 50 attached according to the present invention. In this example base cup 50 has an opening 53 in the underneath sidewall 52 of the base cup. The sidewall 51 of the base cup is generally designed to firmly grasp the container. The container is held vertically aligned by the step 55 contacting with the underneath side of the container. Vertical alignment is further assured by the small upstanding ring 54, which steps from the underneath sidewall 52 into the opening 53. Ring step 54 establishes contact with the upstand 28 in the base of the container, and assists general alignment of the container within the base cup.

The generally tight fit and excellent alignment that is achieved between the base cup and the container means the container does not require gluing or welding to the base cup, and both parts are able to be distributed together easily to the filling location. As no glue is used, the operation of removing the base cup at a later stage of the processing of the container is made easier.

The container of FIG. 20 may be manufactured in a single stage, without the need to manipulate the base into a stable upwardly inclined position prior to delivery.

The attachment of temporary base cups in this manner provides for minimal changes to the processing line at a filling location. The containers may enter the existing system and be handled in the normal manner and without the need to provide additional line alterations. Referring to FIG. 22*a-d*, after filling, capping and cooling (not shown), and immediately prior to labelling, a means for applying force against the panel is provided, for example in a single actuator, such as an extendable rod mechanism 22, may move the panel 20 in to an upwardly inclined position and to then strip the base cup from the container for re-use.

It will be appreciated that the actuator may take many different forms, such as the simple probe 22 attached to any mechanical device for vertically extending the probe upwards. Alternatively, as shown in FIGS. 23 *a-d* wherein the actuator may take the form of a stationary rod 23 attached to a platform 42, and whereby the container is lifted and lowered at the appropriate intervals to provide the contact force required between the rod and the panel.

Figure 24A:
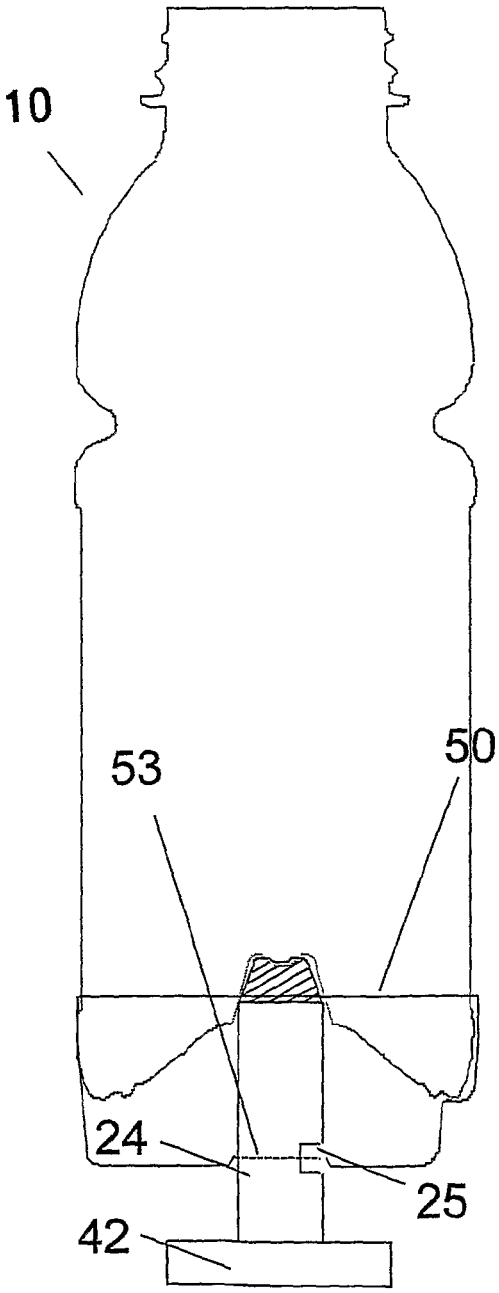
FIG. 24*a-b*: show side cross-sectional views of the container of FIG. 20 according to a further alternative embodiment of the invention incorporating a further alternative pusher to provide panel folding and removal of the base cup
Figure 24B:
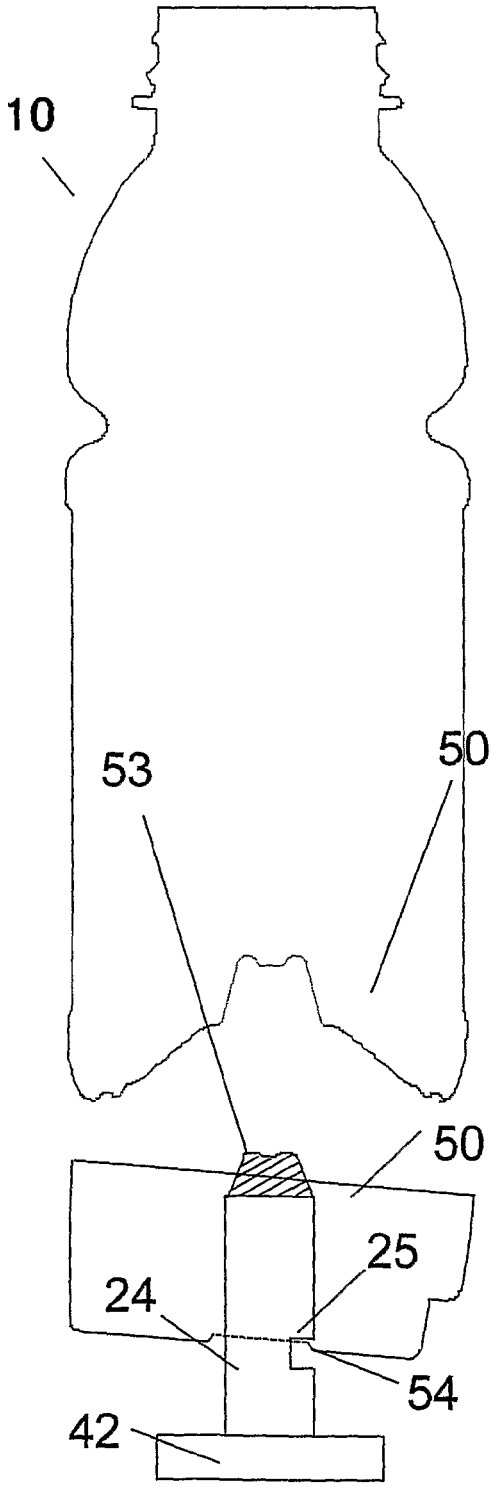

It will be appreciated that the mechanical actuator may further be designed to remove the base cup after the panel has been forced into the upwardly inclined position. One example for this is shown in FIGS. 24 *a-b* wherein a step mechanism 25 in the rod 24 connects with the step mechanism 54 in the base cup 50, as the container is lifted from the rod. It will be appreciated that many mechanical alternatives may be provided to achieve this end result.

Figure 26A:
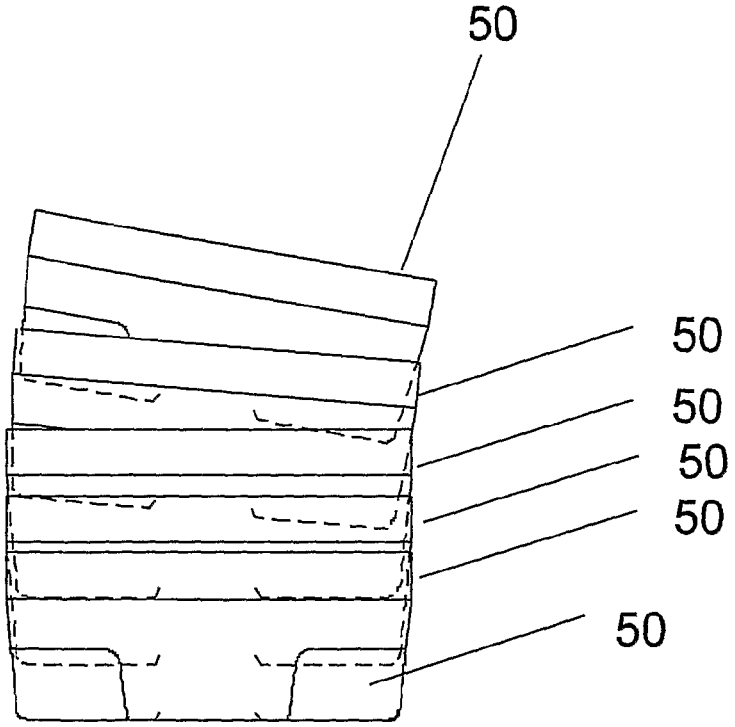
FIG. 26*a-b*: show a side and side perspective views respectively of the base cups of FIGS. 21*a-b* according to a further alternative embodiment of the invention providing for the base cups to be stackable.
Figure 26B:
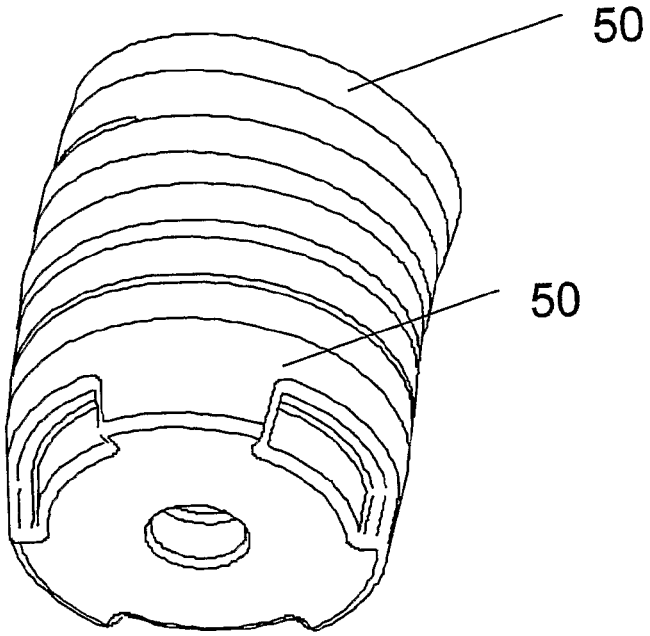
Figure 27A:
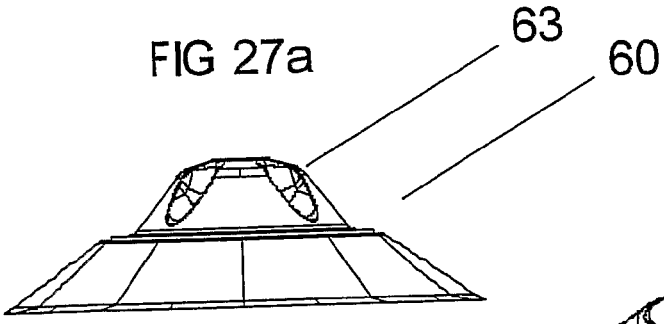
FIG. 27*a-d*: show side, side perspective, plan perspective, and plan views respectively of an alternative base cup arrangement according to a further embodiment of the invention.
Figure 27B:
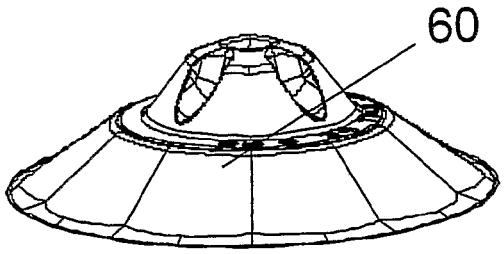
Figure 27C:
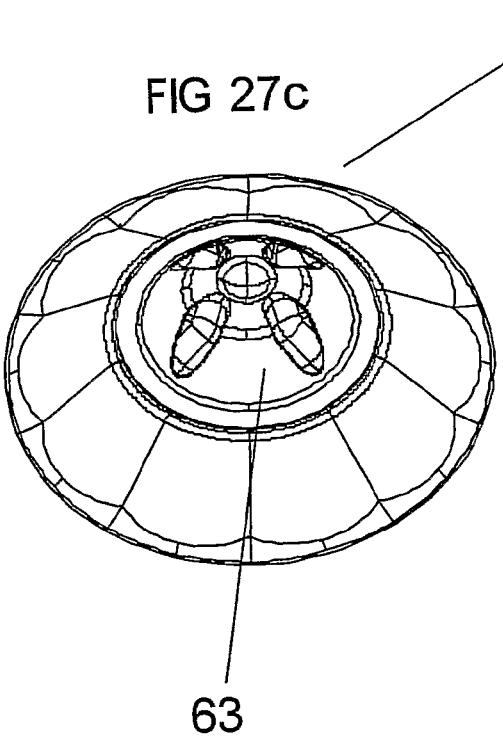
Figure 27D:
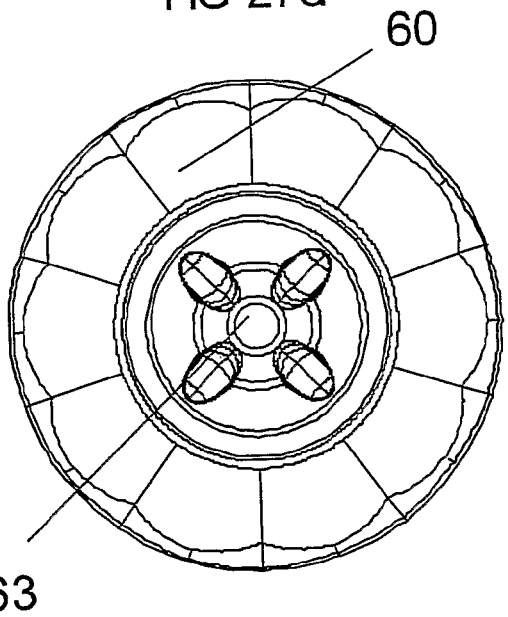
Figure 28A:
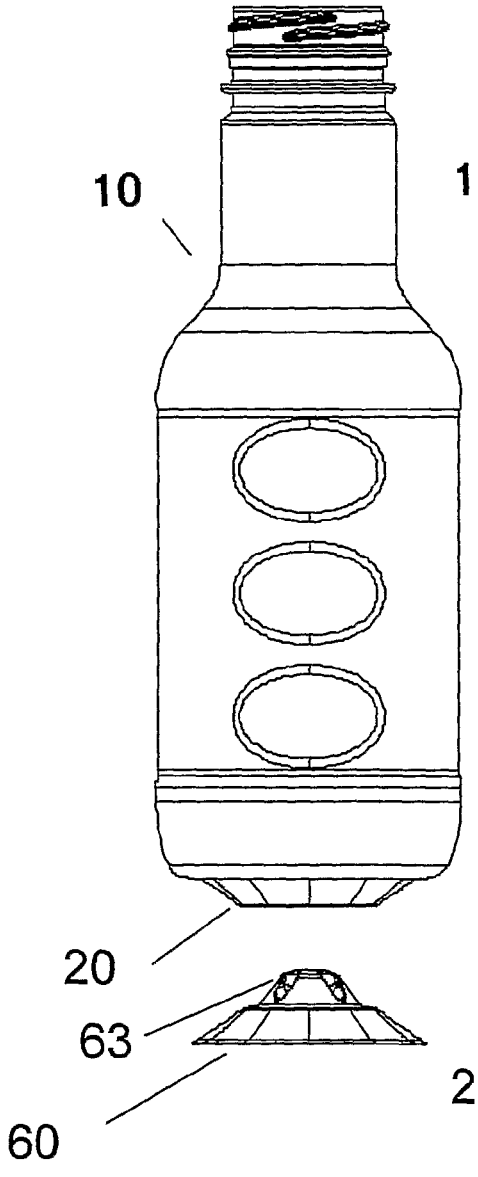
FIG. 28*a-d*: show the base cup of FIGS. 27*a-d* attached to an alternative container according to a further alternative embodiment of the invention.
Figure 28B:
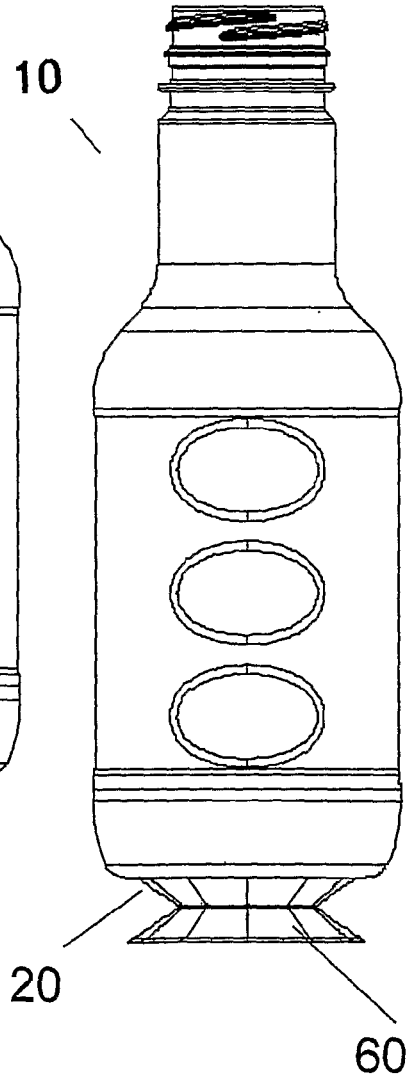
Figure 28C:
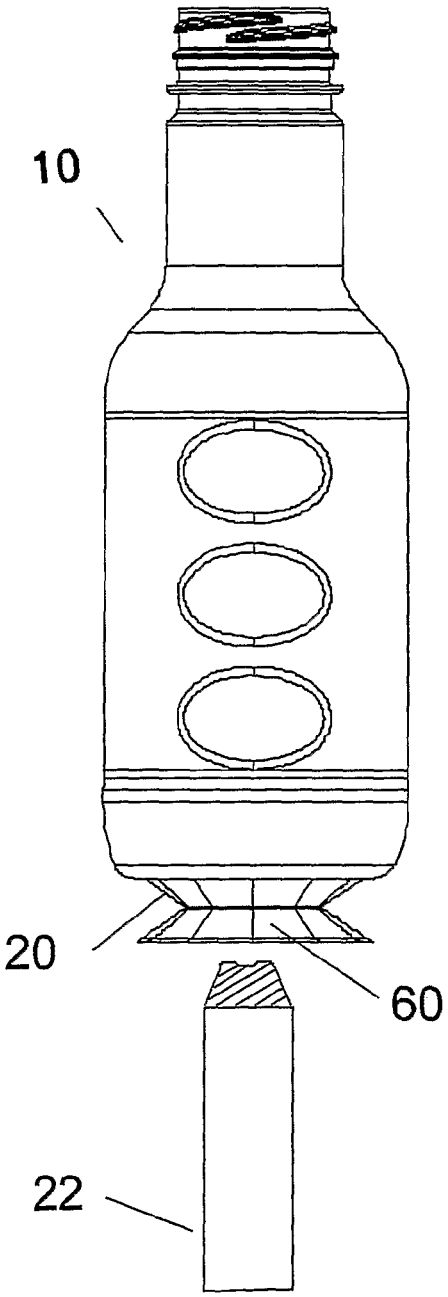
Figure 28D:
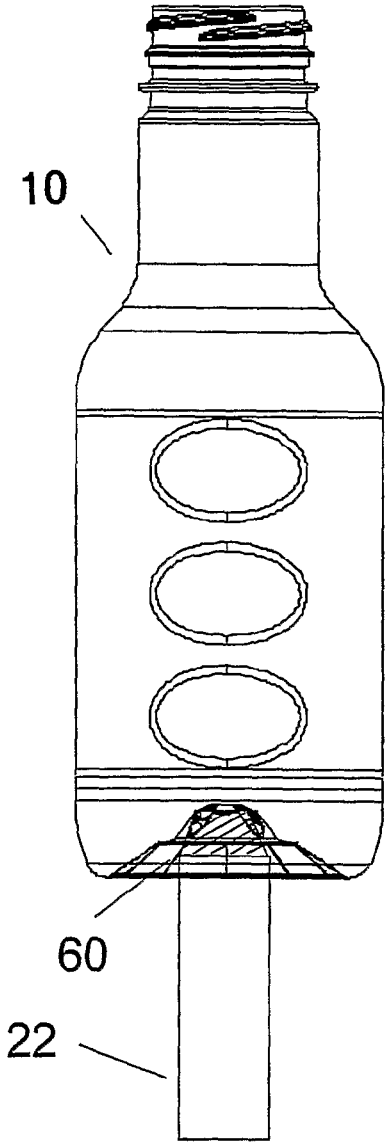

Upon removal of the base cup 50, which may be achieved by many mechanical alternative additions to the examples given, the base cups may be collected either in stacked form as shown in FIGS. 26 *a-b* or collected randomly. Once collected they may be returned for reuse on new containers, thereby eliminating the expense of new manufacture and avoiding recycling issues associated with containers of one material being attached to base cups of another plastic material.

Of course it will be appreciated that the base cups may in fact be left attached to the container, as is traditionally done in the beverage industry. This may be preferred if increased protection is desired for the lower end of the container within the distribution system for example.

This preferred aspect of the invention, whereby a container may be manufactured with the vacuum panel in the downwardly inclined position and then placed in a temporary base cup that is recovered at the end of the filling line after vacuum panel activation, provides for the most cost effective delivery system of such containers.

Return of the base cups to the bottle manufacturer is easily provided. Containers are generally transported to filling locations in bulk by truck. Once delivered, the trucks return generally empty to receive more containers for further delivery. The base cups occupy much less room than the containers, and so return delivery to the bottle manufacturer is readily available via the empty trucks on their return visit to the bottle manufacturer.

According to yet another aspect of the present invention, therefore, the system may preferably include a dedicated mechanical device for removing the container from the base cup and a dedicated collection and storage device or conveyor for conveying and stacking the base cups for return delivery to the bottle manufacturer.

Of course, it will be anticipated that within the scope of the present invention a suitable container handling system could provide the means for base cup attachment to occur at the filling location as a first step, rather than at the bottle manufacturer as a last step. In this instance, the base cups may be collected after being stripped from the containers and returned to this location, rather than to the bottle manufacturer.

In an alternative embodiment of the present invention, the container may be delivered with the vacuum panel in the upwardly inclined position, however. A base cup may be attached either at the bottle manufacturing location prior to delivery, or it could be attached at the filling location if so desired.

FIG. 25 *a-d* illustrates a typical container with the vacuum panel in the upwardly inclined position with a base cup attached according to this embodiment of the invention.

Figure 25A:
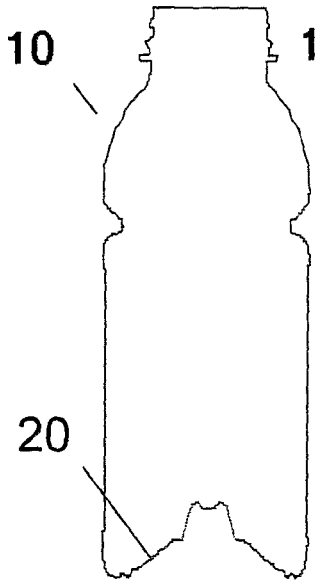
FIG. 25*a-f*: show side cross-sectional views of the container of FIG. 20 according to a further alternative embodiment of the invention incorporating a first actuator for extending the vacuum panel
Figure 25B:
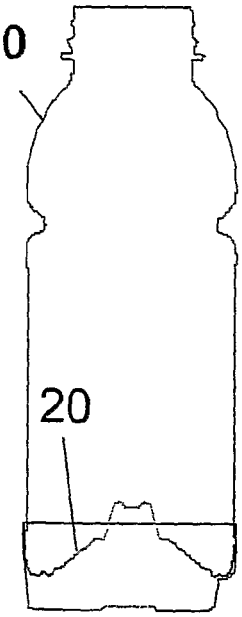
Figure 25C:
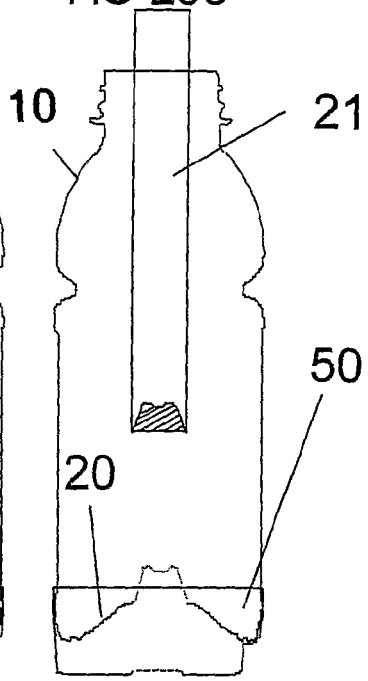
Figure 25D:
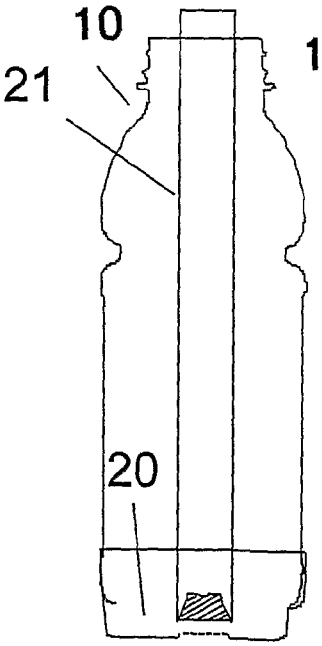
Figure 25E:
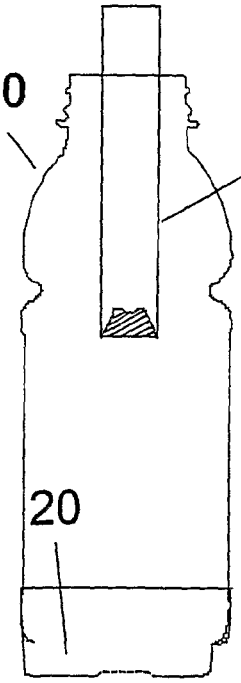
Figure 25F:
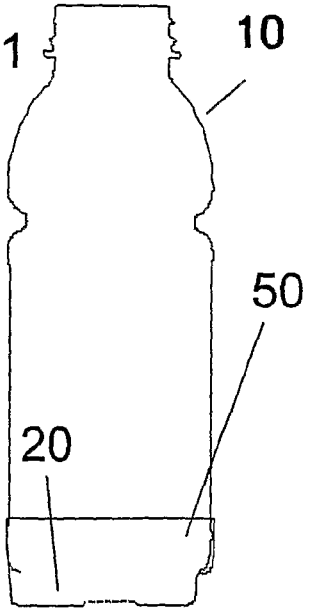

The container 10 of FIG. 25*a* may be formed with the vacuum panel in the upwardly inclined position, and following ejection from the mould, the container will have a good degree of vertical stability and may be delivered to the processing line in this position.

Alternatively, the container of FIG. 25*a* may be blow moulded with the vacuum panel in the downwardly inclined position, and then, in order to achieve geometric stability prior to delivery the vacuum panel may be forced into an upwardly inclined position, for example within the blow mould prior to ejection.

Referring to FIG. 25 *b* therefore, the container may be either inserted into a base cup 50 at the bottle manufacturing site or at the filling and processing site. Either way, vertical stability would be achieved until the base cup is attached.

In this example there is a method of handling a container, which has a vacuum panel 20 on a bottom side thereof and which has a geometrically stable configuration when the vacuum panel is retracted prior to processing, and a geometrically unstable configuration when the vacuum panel is extended subsequently during processing.

Referring to FIGS. 25 *c-d*, the method includes holding the container in the base cup 50, applying a first force to the vacuum panel to move the vacuum panel to an extended or deactivated position wherein the container has an increased volume, holding the container while applying the first force, and conveying the container for further processing, such as filling.

In addition, after the container is filled, a second force is applied to the vacuum panel to move the vacuum panel to a retracted or activated position wherein the vacuum panel in the container is moved into an upwardly inclined position and the container is returned to a geometrically stable configuration.

Thereafter, the container can be removed from the base cup and conveyed for further processing.

It is seen that the present invention provides a container handling or processing system in which the base cup or any other suitable container holder or transporting means can enable the container to be conveyed and supported in its geometrically unstable and stable configurations. Suitable actuating means are provided for the system so that the panel or projection of the container can be moved to and from its unstable and stable configurations. The system may, as will be appreciated, include the steps of filling the container with the product, which may or may not be hot, the capping of the neck of the filled container, optionally the cooling of the filled container, when the moving or pushing of the panel or projection into the container may provide a reduced vacuum pressure or an increase in container pressure. The increased pressure in the container may provide a reinforcement of the sidewall of the container.

In this form of the invention, the container of FIG. 25 *a-d* must first have the vacuum panel extended or 'deactivated' in position to increase the volume in the container while the container is supported by the base cup prior to being filled with liquid product.

This is achieved by providing a first mechanical 'actuator' 21 that moves the vacuum panel of the container 10 from an upwardly inclined position to a downwardly inclined position. When the vacuum panel 20 is forced to the downwardly inclined position, the container has a geometrically unstable configuration which is compensated for by the attachment of the base cup 50 for conveying the container to a container filling portion of the processing system.

The base cup 50 holds the container 10 while in its geometrically unstable configuration. After the container is filled, the container and base cup are conveyed to a second actuator that moves the vacuum panel of the container to an upwardly inclined or 'activated' position while the container is supported by the base cup wherein the container is returned to a geometrically stable configuration.

In this aspect, the first actuator 21 includes an extendable rod, which is extendable for moving the vacuum panel to its extended or deactivated position. For example, the extendable rod extends into the container for moving the vacuum panel to its extended position to increase the volume of the container so that the container can be filled using a hot-fill and post-cooling process without distorting the sidewalls of the container.

From this stage, the container 10 may be transported by conveyer to a second actuator for further processing. It will be appreciated that this further processing is essentially as already described in FIGS. 22 *a-d*.

Referring again to FIGS. 22 *a-d*, therefore, the extendable rod 22 is extendable to apply a compressive force to the vacuum panel from the underside of the container 10 to move the vacuum panel to its retracted position. The device utilised for the second activation of the panel by a mechanical force could be described as being the second actuator. The second actuator therefore reduces the volume in the container to minimize the distortion of the sidewalls of the container resulting from the vacuum formed in the container. Alternatively, the second actuator may simply push the container and base cup against a punch, or the like, in order to apply a longitudinal force against the vacuum panel to move it upwardly.

The stabilising base cup 50 therefore, in any or all examples of the present invention, may comprise an opening 53 in the underneath side to allow for the extendable rods of the second actuator to pass through and contact with the underneath side of the container.

The extendable member of the second actuator, therefore, can extend through the underneath opening of the base cup to apply the compressive force to the underside of the container through the container holder to move the vacuum panel of the container to its upwardly inclined or retracted position.

It will further be appreciated that the base cups may be of many different styles and many designs of base cup or other holders or supporting or conveying means could be utilised without departing from the scope of the present invention. For example, a further embodiment of base cup of the present invention is shown in FIGS. 27*a-d*.

In this example the base cup 60 is designed to use much less material than in the previous example, and does not have an opening in the underneath side to allow for the actuator rod to pass through. Instead, the central portion 63 is enclosed and designed to be attached to the underside of the container as shown in FIG. 28 *a-b*. As disclosed in FIG. 28 *c-d*, the actuator rod applies force against the base cup 60 at the point of the central portion 63, causing the panel to be forced in to the upwardly inclined position.

Figure 29A:
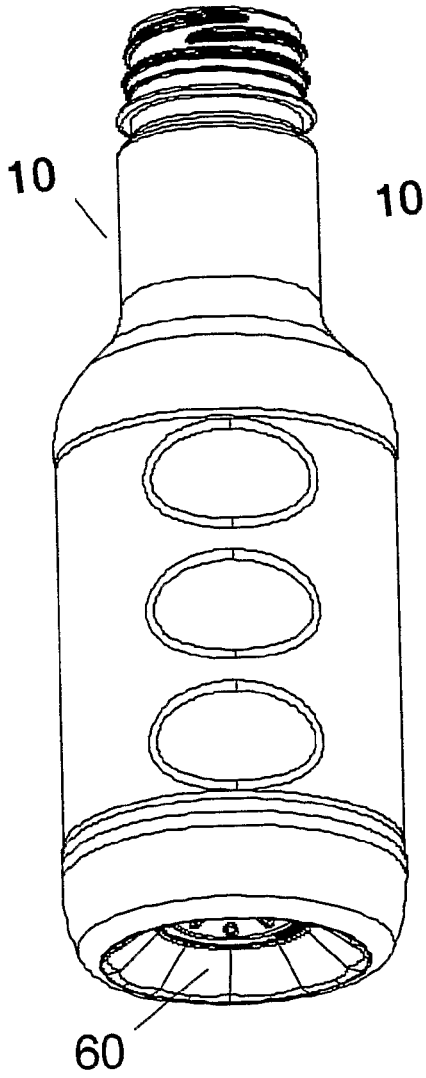
FIG. 29*a-b*: show side perspective views of the container and base cup of FIGS. 27*a-d* with the base cup forced into the base recess of the container.
Figure 29B:
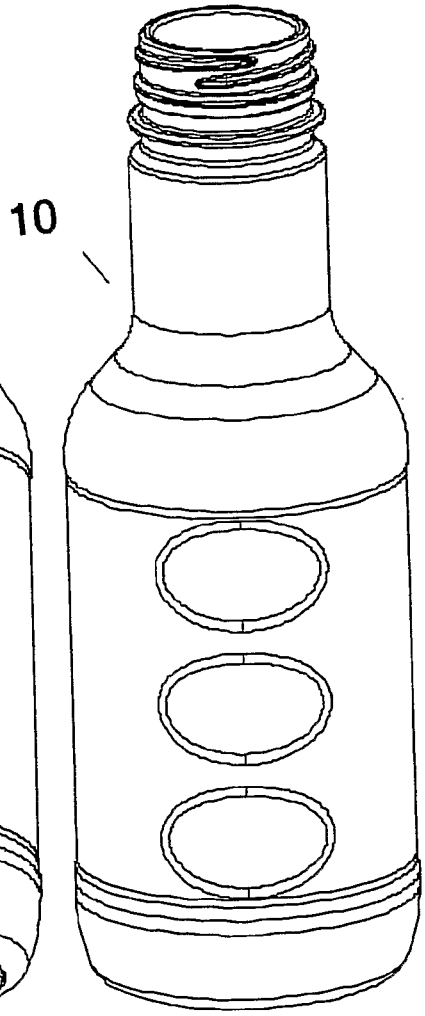

Following this, the base cup may either be removed or left attached to the container. If left attached to the container the base cup 60 becomes largely invisible to the consumer as shown in FIGS. 29 *a-b*.

These and other objects, advantages, purposes, and features of the invention will become more apparent from the study of the following description taken in conjunction with the drawings.

Where in the foregoing description, reference has been made to specific components or integers of the invention having known equivalents then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

The invention claimed is:

1. A method of processing a container for removing vacuum pressure, said container having a longitudinal axis and at least one vacuum panel at a bottom end-wall, the longitudinal axis extending from the bottom end-wall to an opening in a top or opposing end of the container, said vacuum panel being moveable from a downwardly inclined position to an upwardly inclined position, wherein the vacuum panel comprises a first portion and a second portion, the first portion being inclined at an angle greater than 100 degrees relative to said longitudinal axis and said opening when the vacuum panel is in the downwardly inclined position, and the second portion being inclined at an angle that is at least 10 degrees less than the first portion when the vacuum panel is in the downwardly inclined position, said method including:

with said container having said vacuum panel in a downwardly inclined position, conveying said container;

capping said container; and applying a longitudinally directed force against said downwardly inclined vacuum panel to move said vacuum panel to an upwardly inclined position.

2. The method of processing a container for removing vacuum pressure as claimed in claim 1 comprising applying said longitudinally directed force by a mechanical pushing means.

3. The method of processing a container for removing vacuum pressure as claimed in claim 2 wherein said pushing means includes an extendable rod or the like and said applying comprises applying the longitudinally directed force with the extendable rod or the like.

4. The method of processing a container for removing vacuum pressure as claimed in claim 2 wherein said pushing means includes a mechanical punch or the like and said applying comprises applying the longitudinally directed force with the mechanical punch or the like.

5. The method of processing a container for removing vacuum pressure as claimed in claim 1, comprising the pre-step of applying a longitudinally directed force against an upwardly inclined vacuum panel to move said upwardly inclined vacuum panel to the downwardly inclined position.

6. The method of processing a container for removing vacuum pressure as claimed in claim 5 wherein said longitudinally directed force applied against said upwardly inclined vacuum panel is applied by a mechanical pushing means.

7. The method of processing a container for removing vacuum pressure as claimed in claim 6 wherein said pushing means includes an extendable rod or the like and the longitudinally directed force applied against said upwardly inclined vacuum panel is applied by the extendable rod or the like.

8. The method of processing a container for removing vacuum pressure as claimed in claim 6 wherein said pushing means includes a mechanical punch or the like and the longitudinally directed force applied against said upwardly inclined vacuum panel is applied by the mechanical punch or the like.

9. The method of processing a container for removing vacuum pressure as claimed in claim 1 comprising attaching the container to a base cup, wherein said base cup is removed or is removable from said container after said vacuum panel is moved from the downwardly inclined position to the upwardly inclined position.

10. The method of processing a container for removing vacuum pressure as claimed in claim 5 comprising attaching the container to a base cup, wherein said base cup is removed or is removable from said container after said vacuum panel is moved from the downwardly inclined position to the upwardly inclined position.

11. The method of claim 1 including the steps of:

filling the container with a hot product in a production line;

capping the opening of the filled container body with a cap in a next operation of the production line;

and moving the vacuum panel into the container after cooling the container so that the resultant, filled and cooled container body has one of a reduced vacuum pressure or an increase in container pressure.

12. The method as claimed in claim 11 wherein, following the step of capping the opening, the container is cooled.

13. The method as claimed in claim 11 wherein the movement of the vacuum panel into the container provides an increased pressure in the container which reinforces a side wall of the container.

14. The method as claimed in claim 11, comprising pushing the vacuum panel downward to increase the volume in the container prior to said filling.

15. The method of processing a container for removing vacuum pressure as claimed in claim 1, wherein said container has a geometrically stable position when said vacuum panel is in the upwardly inclined position.

16. The method as claimed in claim 1 comprising filling said container with a heated or heatable liquid and cooling the heated liquid inside said container.

17. The method of claim 1 wherein said angle of the first portion is between 100 degrees and 135 degrees or between 100 degrees and 120 degrees or between 120 degrees and 135 degrees.

18. The method of claim 1, including the steps of:

filling the container with a hot product in a production line;

capping the opening of the filled container body with a cap in a next operation of the production line;

and pushing the downwardly inclined vacuum panel into an upwardly inclined position so that the resultant container body has one of a reduced vacuum pressure or an increase in container pressure.

19. The method of claim 18 comprising cooling the product.

20. The method of processing a container for removing vacuum pressure as claimed in claim 2 wherein the mechanical pushing means is applied to a central portion of the vacuum panel.

21. The method of processing a container for removing vacuum pressure as claimed in claim 20 wherein the central portion of the vacuum panel includes an upwardly inclined portion.

22. The method of processing a container for removing vacuum pressure as claimed in claim 1, wherein the vacuum panel includes at least one outwardly directed portion.

23. The method of processing a container for removing vacuum pressure as claimed in claim 22, wherein said at least one outwardly directed portion comprises an outwardly directed flute or rib portion.

24. The method of processing a container for removing vacuum pressure as claimed in claim 1, wherein the first or second portion of the vacuum panel includes at least one inwardly directed portion.

25. The method of processing a container for removing vacuum pressure as claimed in claim 24, wherein said first or second portion includes inwardly directed flute or rib portions.

* * * * *